US006756901B2

(12) United States Patent
Campman

(10) Patent No.: US 6,756,901 B2
(45) Date of Patent: Jun. 29, 2004

(54) MULTI FUNCTION ELECTRONIC PERSONAL MONITOR AND RADIO TELEMETRY CELL SYSTEM

(76) Inventor: James P Campman, P.O. Box 167, Transfer, PA (US) 16154

( * ) Notice: Subject to any disclaimer, the term of this patent is extended or adjusted under 35 U.S.C. 154(b) by 132 days.

(21) Appl. No.: 10/015,661

(22) Filed: Dec. 17, 2001

(65) Prior Publication Data

US 2003/0112144 A1 Jun. 19, 2003

(51) Int. Cl.[7] ..... G08B 23/00

(52) U.S. Cl. ..... 340/573.1; 340/539.1; 340/539.13; 340/539.21; 340/539.23; 340/825.49; 342/458; 701/207; 455/69; 455/456.1

(58) Field of Search ..... 340/573.1, 573.4, 340/5.61, 825.49, 540, 539.1, 539.13, 539.21, 539.23; 455/69, 522, 526, 456.1, 456.2, 456.3; 342/458, 463, 465; 701/207, 117, 213, 214, 215; 370/342, 343; 375/130, 131, 132, 134, 135, 136

(56) References Cited

U.S. PATENT DOCUMENTS 5,204,686 A * 4/1993 Petrelis et al. ..... 342/374
6,169,759 B1 * 1/2001 Kanterakis et al. ..... 370/342
6,304,755 B1 * 10/2001 Tiedemann, Jr. et al. ... 455/437
6,351,640 B1 * 2/2002 DeMont ..... 455/426
6,411,819 B1 * 6/2002 Gutowski ..... 455/525
6,438,380 B1 * 8/2002 Bi et al. ..... 455/456
6,577,849 B1 * 6/2003 Eaton et al. ..... 455/31.1

* cited by examiner

*Primary Examiner*—Davetta W. Goins
(74) *Attorney, Agent, or Firm*—Daniel K. Dorsey

(57) ABSTRACT

A multi function personal alert safety cell system having condition responsive sensors and an alarm for emergency type personal. The personal alert safety cell system having a transceiver. The transceiver for transmitting and receiving at several different radiated power levels, defined as $P_1$, $P_2$, $P_3$, $P_4$, $P_5$, through $P_n$ that vary in signal strength from 1 microwatt through 1 watt. Each power level $P_1$, $P_2$, $P_3$, $P_4$, $P_5$, through $P_n$ being transmitted and received with encoded data and a personal ID uniquely assigned to the transceiver of the cell system. Also, the transceivers transmitting and receiving data being contained within a time frame and having digital instructions and coded format sectors. The power level ID varying in field strength for defining a distance at which the transceiver detects the transmitted and received signal from another of PASS transceiver and the signal being indicative of the distance the transceiver is from the other PASS transceivers.

51 Claims, 18 Drawing Sheets

FIG. 4

| | Transmitted Power | Received Signal Distance | Relative Field Strength Assigned # | Digital Encoded Power Level I.D. |
|---|---|---|---|---|
| $P_1$ | 1 Microwatt | 10 Feet | 1 | 1 |
| $P_2$ | 10 Microwatt | 50 Feet | 2 | 2 |
| $P_3$ | 100 Microwatt | 100 Feet | 3 | 3 |
| $P_4$ | 1000 Microwatt | 200 Feet | 4 | 4 |
| $P_5$ | 10 Milliwatt | 500 Feet | 5 | 5 |
| Pn | x watt | x Feet | n | n |

Power = 1 Microwatt
Frequency = $f_1$

Power = 1 Microwatt
Frequency = $f_2$

Power = 10 Microwatts
Frequency = $f_3$

Power = 10 Microwatts
Frequency = $f_4$

Power = 100 Microwatts
Frequency = $f_5$

Power = 1000 Microwatts
Frequency = $f_6$

Power = 1000 Microwatts
Frequency = $f_7$

Power = 10 Milliwatts
Frequency = $f_8$

Power = 100 Milliwatts
Frequency = $f_9$

Power = 100 Milliwatts
Frequency = $f_{10}$

MULTI FUNCTION ELECTRONIC PERSONAL MONITOR AND RADIO TELEMETRY CELL SYSTEM

BACKGROUND OF THE INVENTION

1. Field of the Invention

The present invention relates to a small, multi-function electronic personal monitor and radio telemetry cell system under the control of a microcomputer.

More specifically, the present invention relates to a personal communicator and monitor with communications consisting of duplex spread spectrum radio telemetry, underwater sonar, acoustic ranging and signaling, infrared communications and visible light communications.

CROSS-REFERENCE TO RELATED APPLICATIONS AND PATENTS

My companion Design application Ser. No. 29/145,071, filed on Jul. 17, 2001, entitled A SMALL PERSONAL COMMUNICATOR, discloses the external casing configuration for the present invention.

My U.S. Pat. No. 6,213,623 patented Apr. 10, 2001 entitled GLOW AND FLASH BATON discloses a resilient watertight light baton is disclosed having multicolored light source and power source mounted therein. The light sources are in electrical communication with the power source via interior electronics and solid state light sources. The exterior walls of the light baton are machined to effectively transmit light from the light source. The baton is extremely easy to use with only one hand and is controlled with a single button.

Additionally, my U.S. Pat. No. 5,317,305 patented May 31, 1994, entitled PERSONAL ALARM DEVICE WITH VIBRATING ACCELEROMETER MOTION DETECTOR AND PLANAR PIEZOELECTRIC HI-LEVEL SOUND GENERATOR, discloses an alarm and lights which include a vibrating accelerator for motion detectors and a planar, low profile sealed, piezo hi-level sound generating transducer structurally and functionally coordinated with a resonating chamber casing structure to provide a hi-level audio alarm.

These inventions are hereinafter incorporated by reference thereto.

2. The Prior Art

The purpose of a small, lightweight personal alert safety system (hereinafter referred to by the acronym PASS) is to sound a loud, highly discernible audio alarm if a distressful situation should occur. A PASS alarm can be activated either manually or automatically. When using a PASS alarm in the automatic mode of operation, the alarm will sense the absence of motion if the wearer should become immobilized for a predetermined (25 second) time period. The alarm will then sound a loud, easily recognized audio alarm that will not turn itself off unless it is manually reset.

This sound serves as an audio beacon that aids others in finding the downed person, such as a fireman, police or other emergency personnel. PASS alarms may also be manually activated to summon help. The devices are normally attached to a SCBA harness, a turnout coat or other protective clothing. A PASS alarm can be a lifesaving device when used properly by personnel involved in hazardous occupations such as firefighting, police, other emergency/rescue type professionals.

PASS devices must be highly reliable and easy to operate. The demand for lighter, smaller and more reliable PASS devices and equipment is an ever-pressing issue. Features that must be considered are size, shape and weight; sound intensity and type of sound; motion detectors; signal processing; temperature alarms; visual indicators; manual and automatic switching; and attachments.

The PASS should have a small, lightweight, low profile shape with no sharp corners. Generally, smaller physical size is more desirable, provided there is no reduction in sound output.

PASS devices that are currently available range in weight from 7 ounces to 13 ounces and exhibit sound intensities that range from 95 dBA through 101 dBA (dBA—unit of sound pressure related to loudness) at ten feet.

The primary objective of a PASS device is to provide a loud, highly discernible sound that is easily heard and recognized under high ambient noise conditions. Two important parameters of sound that must be considered are sound loudness (intensity) measured in dBA and sound discernability (the ability to recognize a particular sound in a high background noise environment).

Some of the earlier PASS devices had a loud sound output (high dBA), but it was difficult to distinguish the source of the sound, and thus it was easily confused with smoke alarm sounds or other coherent sound sources. Present day PASS devices have overcome the problem of locating the source from which the sound signal is originating by modulating a pure tone or generating a sound that consists of several intermittent tones.

Another, and possibly the most desirable audio sound, is that of a sweep frequency (most discernible). This type of sound will generate multiple tones that sweep from two thousand cycles through six thousand cycles. It is not easily masked by background noise. The actual sound generators are usually of the piezoelectric type and are considered the best means for generating high sound levels.

Manufacturers of PASS devices provide features as defined by the NFPA standard 1982, 1988 edition. This standard defines the minimum requirements and specifications for electronic and mechanical characteristics as well as environmental specifications.

The sensor that permits a PASS device to operate when in the automatic mode (responsive to motion or lack of it) is called a motion detector. These motion detectors are an extremely important part of a PASS device. If the sensor is not sensitive enough to sense random motion, the PASS alarm will constantly be going into a pre-alert condition, becoming an irritation to the wearer of the device. The ideal sensor is one that only requires normal motion to keep the PASS inhibited, yet will be sensitive enough to immediately sense lack of motion when a person is motionless.

Some motion sensors that are currently used by manufacturers of PASS devices are mechanical types that depend on movement of a small metal ball to sense motion. This random motion of the ball is then converted into an electrical signal as long as motion exists. Another popular method of sensing motion is accomplished by the closing of a mercury filled switch with respect to motion.

A third and possibly more progressive method involves a solid-state accelerometer device that can sense a broad range of motion and is not position sensitive.

For the system circuitry, most PASS manufacturers use either a custom micro-chip or a micro-processor chip. Some chip functions are timing, automatic low battery sensing alarm, motion signal processing and sound generation. A quartz crystal is sometimes used to insure accurate timing.

Added features in PASS devices, not covered by the NFPA mandate are: high temperature sensing and alarms; visual indicators; switches; and attachment devices.

Heat sensing alarms that are an integrated part of a PASS device, sound an audio alarm, different from the automatic PASS alarm sound, when life threatening temperatures are encountered. Those PASS devices equipped with temperature sensing alarms should only be regarded as a relative indicator that life threatening temperatures may exist, and are not to be interpreted as an absolute indicator. Temperature sensing PASS devices typically operate on an integrated time versus temperature scheme, and are dependent upon the thermal inertia of the PASS device type of heat sensor used, and the logistics at the fire scene. Accuracy at temperatures that the heat alarm will sound can vary.

Most PASS devices are provided with a flashing LED indicator. This indicator provides the user with a visual beacon, but perhaps more important, it can serve as an indicator that the PASS electronics are functioning properly. Most manufacturers provide a visual indicator. The most common indicator is a blinking LED or a combination of LED's that are programmed to flash in a wig-wag fashion for ease of recognition.

Some manufactures utilize a mechanical switch to activate their PASS devices. These switches must be reliable and easy to manipulate, even with a gloved hand. A more recent improvement in switching is used in the present invention and is the all-electronic switch (no moving parts).

Attachment devices vary with different PASS manufacturers. Captive clips are designed to fit the SCBA harness. This type of attachment device does not adapt itself for easy attachment to turnout coats and other gear. Other types of attachment devices include D-rings and fast acting grip clips. The grip clip may be considered the most universal since it permits attaching the pass device to clothing, belts or harnesses by affixing itself with a clamp-like "clop" action. All of the aforementioned attachment devices serve the purpose for which they were designed.

Examples of personal alarm devices which show one or more of the aforementioned desirable features can be found in the following patents. U.S. Pat. No. 3,614,763 to Yannuzzi for PRONE POSITION ALARM which is in a small case and can be clipped over a belt and uses a motion sensitive mercury switch and a cone type of audio speaker; U.S. Pat. No. 4,253,095 to Schwarz et al for ALARM APPARATUS FOR DETECTING DISTURBANCE OR OTHER CHANGE OF CONDITION, which also is housed in a small casing and uses an open structure, round piezoelectric element as a sound generator; U.S. Pat. No. 4,418,337 to Bader for ALARM DEVICE, has a small housing with a solenoid and induction coil type of motion detector, a printed circuit board and horn-shaped speaker for the audio alarm; and U.S. Pat. No. 4,914,422 to Rosenfield et al for a TEMPERATURE AND MOTION SENSOR, which is in a small casing and provides highly visible green and red colored position indicators for the on-off switch, a temperature sensor, a motion detector (not disclosed) and an audio sound generator which emits different tones for temperature and motionless sensing.

Examples of piezo electric vibrating accelerometers can be found in the following patents: U.S. Pat. No. 3,113,223 to Smith et al for BENDER TYPE ACCELEROMETER which uses a piezo element as the motion sensing mass; U.S. Pat. No. 3,456,134 to Ko for PIEZOELECTRIC ENERGY CONVERTER FOR ELECTRONIC IMPLANTS which uses a cantilever mounted crystal strip as the vibrating support for a small weight mass on the end of the strip; U.S. Pat. No. 4,051,397 to Taylor for a TWO DENSITY LEVEL KINETIC SENSOR which uses a piezo electric strip with a weight at one end and the other end is mounted to a planar unit which contacts a unit whose motion is to be sensed; U.S. Pat. No. 4,441,370 to O. Sakurada for VIBRATION SENSOR which uses a vibrating piezo electric strip; and U.S. Pat. No. 4,712,098 to Laing for INERTIA SENSITIVE DEVICE which uses a weighted plate of piezo electric material.

Examples of piezo electric sound generating transducers can be found in the following United States patents: U.S. Pat. No. 3,761,956 to Takahshi for SOUND GENERATING DEVICE; U.S. Pat. No. 4,240,002 to Tosi for PIEZOELECTRIC TRANSDUCER ARRANGEMENT WITH INTEGRAL TERMINALS AND HOUSING; U.S. Pat. No. 4,604,606 to Sweany for AUDIO SIGNALING DEVICE; U.S. Pat. No. 4,907,207 to Moecki for ULTRA SOUND TRANSDUCER HAVING ASTIGMATIC TRANSMISSION/RECEPTION CHARACTERISTICS.

A major problem that prevails with the prior art devices is that the devices are not able to locate an emergency personnel when he or she is lost or disoriented and is in need of a search and rescue team. In fact, there has been an unusually large number of firefighter deaths that have occurred because of firefighters becoming lost in or disorientated in the heat and fury of the fire or other disaster situations. This occurs particularly in present day high rises wherein the steel buildings, concrete walls or other structure clutter confuses the pathways and exits.

At the present time, the search team has no special equipment for finding a lost emergency personnel which can specifically provide the search team information regarding the location of the lost emergency personnel. There are many schemes that have been tried in years past including the powerful GPS locating system via the satellite network. The shortcomings of these systems usually are the complexity, fragility, limited accuracy and cost. Additionally, many of these systems will not work when inside steel buildings, concrete walls or other structure clutter.

SUMMARY OF THE INVENTION

A need exists for a simple and reliable cell system for locating a lost firefighter or other personnel under nearly any emergency condition or disaster situation. The present invention provides such a cell system. The cell system contains a radio receiver which is controlled by a microprocessor that manages several tasks. When the information from these tasks are combined in a unique method, the resulting location and distance between a locator radio transmitter and a smart radio receiver can be determined.

The cell system further includes a locator transmitter device for sending out a radio signal that is repeated on at least 100 different frequencies in the range of 902 MHz to 928 MHz. The transmitted radio signals contain an encoded message with information including the transmitted RF signal power. These signals will be received and processed by a smart radio receiver.

The processing by the smart radio receiver will include measuring the received RF signal strength, or power, from each transmitted radio message. These received RF signal power measurements will be mathematically summed and processed by the radio receiver's microprocessor to calculate an average value for the received RF signal strength level for each RF power level transmitted. This average received RF signal strength value, along with the power level data contained in the transmitted radio messages, will be representative of the distance between the locator radio transmitter and the smart locating receiver.

Repeating the transmitted message on many different frequencies at many different power levels enhances the accuracy of the distance computed by significantly reducing the effects of an uneven radiation pattern. The uneven radiation pattern is often exhibited by radio signal propagation due to various dynamic conditions such as a frequency transmitted power level antenna and the environment. Accordingly, because the radiated power level varies as will the frequency of the transmitted power, the probability of receiving even the weakest of signals is greatly enhanced.

It is an object of the invention to provide a PASS cell system with a transmitter for transmitting data unique to the cell system at multiple frequencies and at multiple power levels.

It is an object of the invention to provide a PASS cell system with a receiver for receiving other data unique to other cell systems at multiple frequencies and at multiple power levels.

Another object of the invention is to have the transmitted unique data contained within a time frame and have digital instructions and coded format sectors.

A further object of the invention is to have the sectors identified through a sector "A" and the sector "A" contains the digital ID preamble and a data code format for another receiver to receive and acknowledge before a reception of a digital data can occur.

A still further object of the invention is to provide the transmitted message at one or multiple power levels as $P_1$, $P_2$, $P_3$, $P_4$, $P_5$, through $P_n$, that vary in signal strength from 1 microwatt through 1 watt.

Another object of the invention is to provide that each of the power level $P_1$, $P_2$, $P_3$, $P_4$, $P_5$, through $P_n$ being transmitted with the data and a personal ID uniquely assigned.

It is an object of the invention that the power level $P_1$ is assigned a digitally encoded field strength power level number of 1, and will have a received signal distance of 10 feet.

It is an object of the invention that the power level $P_2$, is assigned of a digitally encoded field strength power level number of 2, and will have a received signal distance of 50 feet.

It is an object of the invention that the power level $P_3$ is assigned a digitally encoded field strength power level number of 3, and will have a received signal distance of 100 feet.

It is an object of the invention that the power level $P_4$ is assigned a digitally encoded field strength power level number of 4, and will have a received signal distance of 200 feet.

It is an object of the invention that the power level $P_5$ has a received signal distance of 500 feet, is assigned a digitally encoded field strength power number of 5, and will have received signal distance of 500 feet.

It is an object of the invention that the power level $P_n$ is assigned a digitally encoded field strength power level number of "X", and will have a received signal distance of "X" feet.

It is an object of the invention that the power levels described could be 1 microwatt for $P_1$, 10 microwatts for $P_2$, and 1 watt for $P_{20}$.

Another object of the invention is that the preamble personal ID is uniquely assigned to at least 100 or more carrier frequencies.

It is an object of the invention that each of the different transmitted frequencies vary in a random like manner.

It is an object of the invention that each of the different transmitted frequencies are sequentially transmitted.

A still further object of the invention is that the time frame is 50 milliseconds or less.

It is an object of the invention that each of the coded format sectors include a plurality of sectors "B" through "I" contain digital data specific to desired functions consisting of at least temperature, metabolism, heart rate, and elapsed time, and a sector "J" containing check sum data for insuring validation of said transmitted data.

Another object of the invention is to provide a plurality of cell systems, each with it's own transmitter, receiver or transceiver and a microprocessor controller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A preferred structural cell system embodiment and preferred subcomponents of this invention are disclosed in the accompanying drawings in which:

FIG. 4 illustrates a table having examples of an encoded radio signal that varies in transmitted signal strength of a lost person locator in accordance with the present invention;

DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
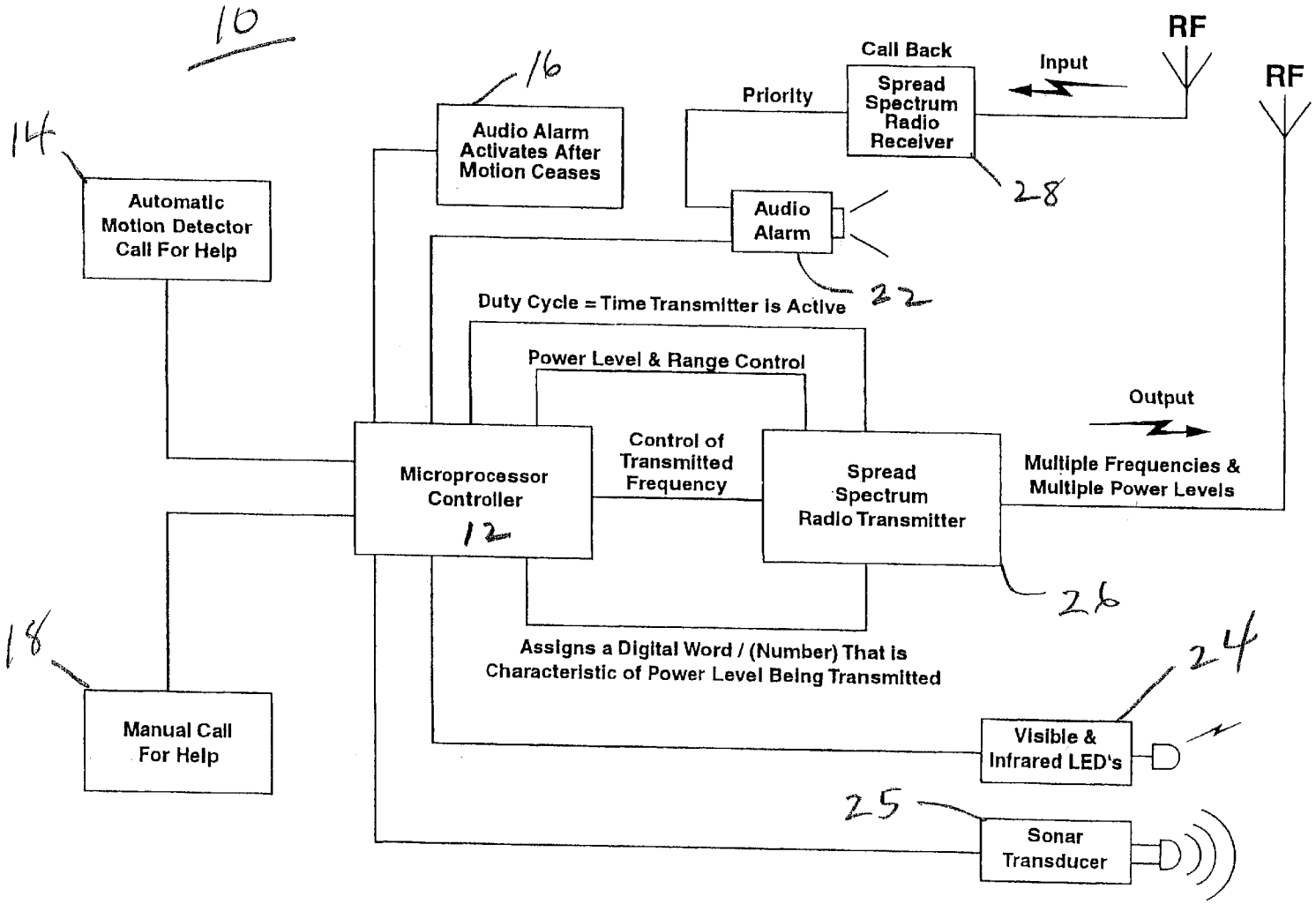
FIG. 1 illustrates a block diagram of a cell system in accordance with the present invention.

FIG. 1 illustrates a block diagram of a cell system which is generally indicated by numeral 10. The cell system 10 is a small, multi-function electronic personal monitor and radio telemetry system under the control of a microcomputer 12 and is contained within a plastic structure that, in the preferred embodiment, measures 2¾ inches by 1¾ inches by 1⅛ inches. The microcomputer 12 is a 8051 basic programmable microcontroller that offers varying capabilities to cost effectively meet the needs of a wide range of applications.

Because of the small size, the cell system 10 may easily be worn as a personal communicator and monitor. The cell system 10 is capable of providing communications consisting of duplex spread spectrum radio telemetry, underwater sonar, acoustic ranging and signaling, infrared and visible light communications.

A motion sensing or detecting circuit 14 is contained within cell system 10 and includes a motion sensor that detects the absence of motion. After detection or lack thereof motion, the circuit activates a loud audible alarm 16 and simultaneously transmits an emergency spread spectrum radio "call for help" distress signal.

To detect motion (or lack of motion) of a wearer of the cell system, this invention incorporates the novel vibrating accelerometer disclosed in my U.S. Pat. No. 5,317,305, entitled "Personal Alarm Device with Vibrating Accelerometer Motion Detector and Planar Piezoelectric Hi-level Sound Generator".

The vibrating accelerometer is a highly sensitive motion detector that will sense motion in all planes of movement. High sensitivity, rugged construction and ability to sense omni-directional motion are characteristic of the embodiments which are described as follows.

The vibrating accelerometer utilize the characteristic of piezo electric material to generate a voltage when caused to flex by vibration caused by motion. Another embodiment could utilizes a change in conductivity resulting from changes of force caused by flexing motion. All the noted embodiments of the vibrating accelerometer use a small ball mass on a lever arm which is a metal strip and/or a wire which is made of spring steel. In turn, the assembly is mounted on a rigid substrate.

When motion occurs, the ball mass moves and relative to the rigid substrate causes the lever arm and spring wire to vibrate in a simple harmonic motion. In the piezo electric types of motion detectors, a piezo electric material is bonded to the lever arm or to a thin metal plate part of a frame mounted on a rigid substrate and to which the lever arm is connected. When motion occurs, the lever arm, described by mass ball and lever arm (with thin plate), causes the metal arm (plate) to flex. This arm or plate flexing causes a piezo electric voltage to be generated between the piezo ceramic material and the arm or the frame assembly. Because the metal ball mass is free to move in any direction, the configuration described will generate a voltage if movement should occur in any plane of movement. The amount of sensitivity and the frequency of the harmonic motion (natural vibrating frequency of ball and lever mass) can easily be adjusted by changing the ball mass and lever arm. The voltage that is generated between conductors is a dampened sine wave that can easily be processed into a pulse train in the circuitry which is described in my U.S. Pat. No. 5,317,305.

In the vibrating accelerometer embodiment which utilizes change in conductivity with changes in force, a ball mass is secured on the end of a lever arm which is spring mounted to a rigid substrate. Resistive material is bonded to the lever arm. A voltage is applied between spaced apart location points on the resistive material. When a vibration of the ball mass and lever arm occurs because of motion, the flexing of the lever causes compression movements in the resistive material which results in a change in its conductivity. The change in conductivity results in a sine wave that as in the previous embodiments is processed into a pulse train.

In all the noted embodiments, lack of motion for a predetermined time period results in a lack of pulse signals which trigger circuitry to cause an alarm to sound. This is generated through automatic activation and annunciation (an audio and radio alarm) signal, if a person becomes immobilized for a predetermined period (25–30 seconds).

The cell system 10 also includes a manual activation member 18 which permits the user to manually activate a signaling mode by pressing a button, using an audible activation or by radio transmission.

The cell system 10 can contain a temperature sensor that telemeters temperature data back to a receiver and sounds an audio alarm contained within the cell system 10 alerting the user that high temperature may exist.

An audible alarm generator 22 generates a sound that can be changed every 15 minutes. This generator is a control logic 8051 chip which is programmable. By changing the sound over the period of time, a sound signature is developed which will help to determine how long a person has been immobilized. A radio signal transmission will occur every minute, if a person becomes immobilized or the timer is manually activated. This can be used to indicate how long a person has been immobilized.

The alarm is in the small compact sound generating device that is used primarily by firefighters to call for help in an emergency. This loud audio alarm may be manually activated, or automatically activated. If the wearer of the PASS device should become motionless for a period of time that exceeds 30 seconds, the alarm will automatically annunciate and latch to the "ON" state (loud audio alarm) until manually reset.

By utilizing the spread spectrum radio telemetry transmitter portion of the cell system 10, the exact time that the alarm has been active may be transmitted back to a remote receiver.

By changing the sound signature, various messages can be relayed to the rescuing personnel. First message is that a person is down. Second message is the sound signature itself. For the first 15 minutes it is in full alarm, every 15 minutes after that, it changes. This gives information of approximately how long the person has been down.

The audible sound emitted from the cell system 10 is a specific continuously modulated one Khz sound that lasts for 15 minutes and comes from audible annunciator 22. At the end of the first 15 minutes sound period, the audible annunciator 22 goes into a 50% duty cycle, i.e. (the alarm is on for one second and off for one second). This type of sound signature indicates that the alarm has been sounding for at least 15 minutes, but not more that 30 minutes.

At the beginning of the third sound period, the alarm changes its sound signature to a 1.5 Khz continuously modulated sound that lasts for 15 minutes. This type of sound indicates that the alarm has been on for at least 30 minutes, but not more than 45 minutes.

At the beginning of the fourth 15 minute period, the alarm sound signature will be a 1.5 Khz continuously modulated sound that lasts for 15 minutes, but is only on for 50% of the time. This type of sound signature indicates that the alarm has been active for a period of time that exceeds 45 minutes. The audible annunciator 22 can be any of a number of chips. In the preferred embodiment a PAZ-10 chip is utilized.

Additionally, contained within the cell system 10 is visual indicator and radio telemetry circuit 24. This circuit 24 is a SFH-4010 chip. A sonar transducer 25 is also shown and utilized in water type situations wherein the transducer can be a PAZ-20 chip.

A digital spread spectrum radio transmitter 26 and radio receiver 28 are also contained within the cell system 10. Each of these can be a programmable chips, such as the SSR-100 and SST-100. Of course, the transmitter 26 and receiver 28 can be a single transceiver or two transceivers that may be activated either automatically or manually.

For automatic radio power level and frequency control, the cell system 10 uses power transmission levels and frequencies which are controlled by the cell system under the command of a proprietary algorithm programmed into the microprocessor 12. The cell system 10 is capable of transmitting and receiving ten or more frequencies. Additionally, the cell system 10 can produce and recognize one hundred or more power levels at the respective frequency. The concept of the power level and frequency control is illustrated and discussed with reference to FIGS. 3–8.

The spread spectrum radio receiver 28 contained in the cell system 10. The spread spectrum radio receiver 28 responds only to data encoded and transmitted from other cell system units. This data contains power level and frequency information, as well as identification information relative to the user of the cell system. The details of this data will be explained more fully with reference to FIGS. 3–8.

An infrared receiver and transmitter LEDs contained within the cell system 10 allow data exchange via an infrared link. These links are similar to those used in lap top computers, PDAs and other similar infrared link systems. Data may easily be read out and displayed from the cell system 10 via this infrared link.

An infrared transmitter/receiver 24 for secured identification is provided. The flashing sequence of infrared LEDs contained within the cell system 10, transmit personal data that can be detected with the infrared transmitter/receiver 24. The transmitter/receiver 24 may also be infrared field glasses with a detector/decoder, in another embodiment.

Figure 2:
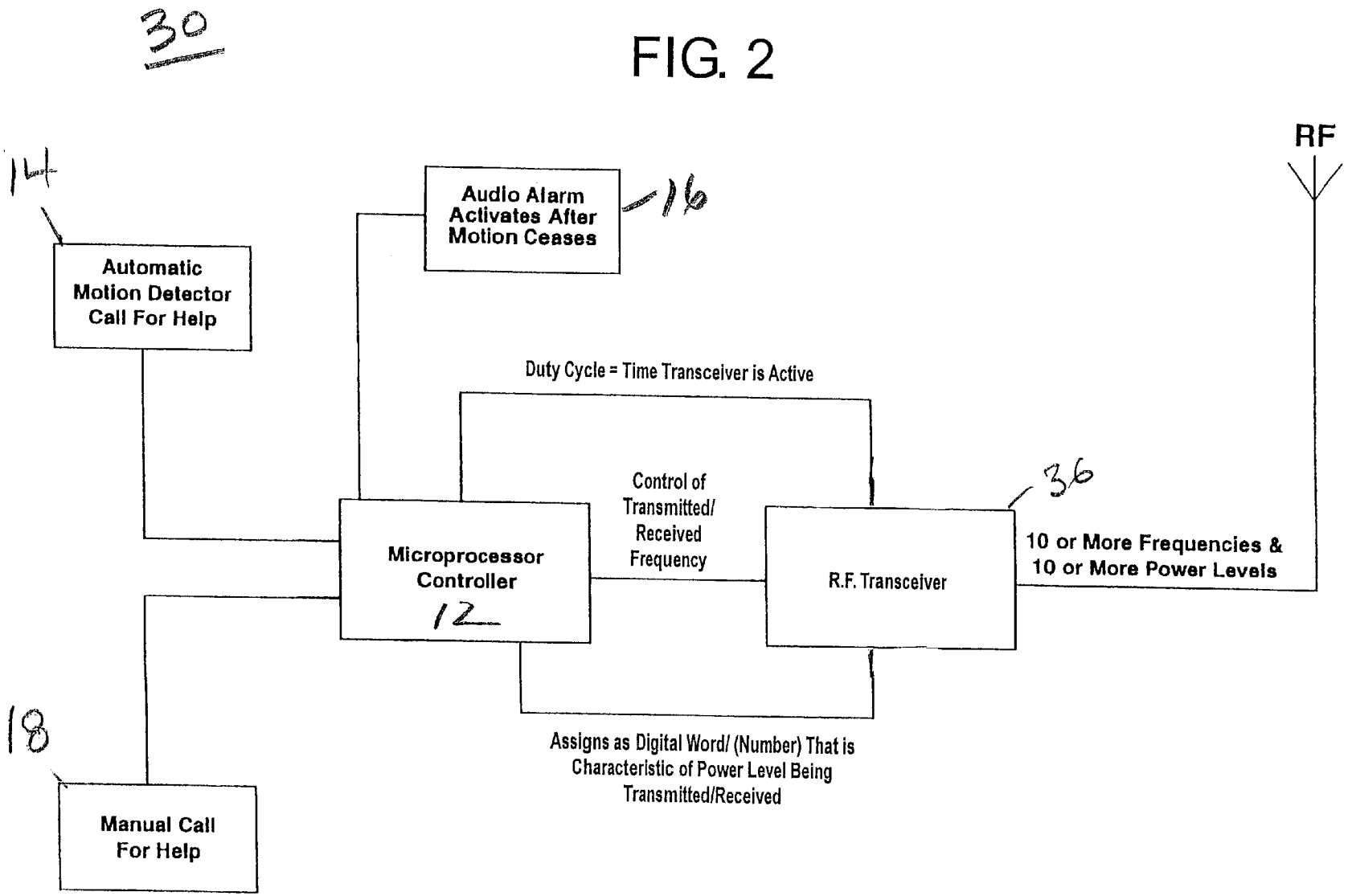
FIG. 2 illustrates a block diagram of a lost person locator in accordance with the present invention.

FIG. 2 illustrates another embodiment of the cell system 10. The figure shows a block diagram of a lost person locator 30 in accordance with the present invention. The locator is similar to the cell system 10 illustrated in FIG. 1. wherein like parts are designated by like reference characters throughout the several views of the drawings. In other words, those features that are of similar construction and operation have the same reference numerals assigned thereto.

In FIG. 2, the locator 30 is illustrated with a radio frequency transceiver 32 which operates as both a transmitter and receiver. The R.F. transceiver 32 is controlled by the microprocessor 12 which manages several tasks. The automatic motion detector 14 will call for help when lack of motion is detected after a set period of time.

As previously indicated, this motion detector 14 is the novel vibrating accelerometer disclosed in my U.S. Pat. No. 5,317,305, entitled "Personal Alarm Device with Vibrating Accelerometer Motion Detector and Planar Piezoelectric Hi-level Sound Generator" which is incorporated herein by reference.

The lost person locator 30 includes the audio alarm 16 which activates after motion ceases. There is also the manual call for help button 18.

The system works in tandem by having either two or more cell systems 10 or two or more locator systems 30 or a combination of the two. As will be further explained, one of the two systems, for example the locator system 30, is worn and the wearer enters an emergency area. The second system, for example the cell system can monitor the locator system 30. Of course, the situation can be reversed. However, for discussion purposes with respect to FIGS. 3–8, it will be understood that the cell system 10 is monitoring the locator system 30.

Figure 3:
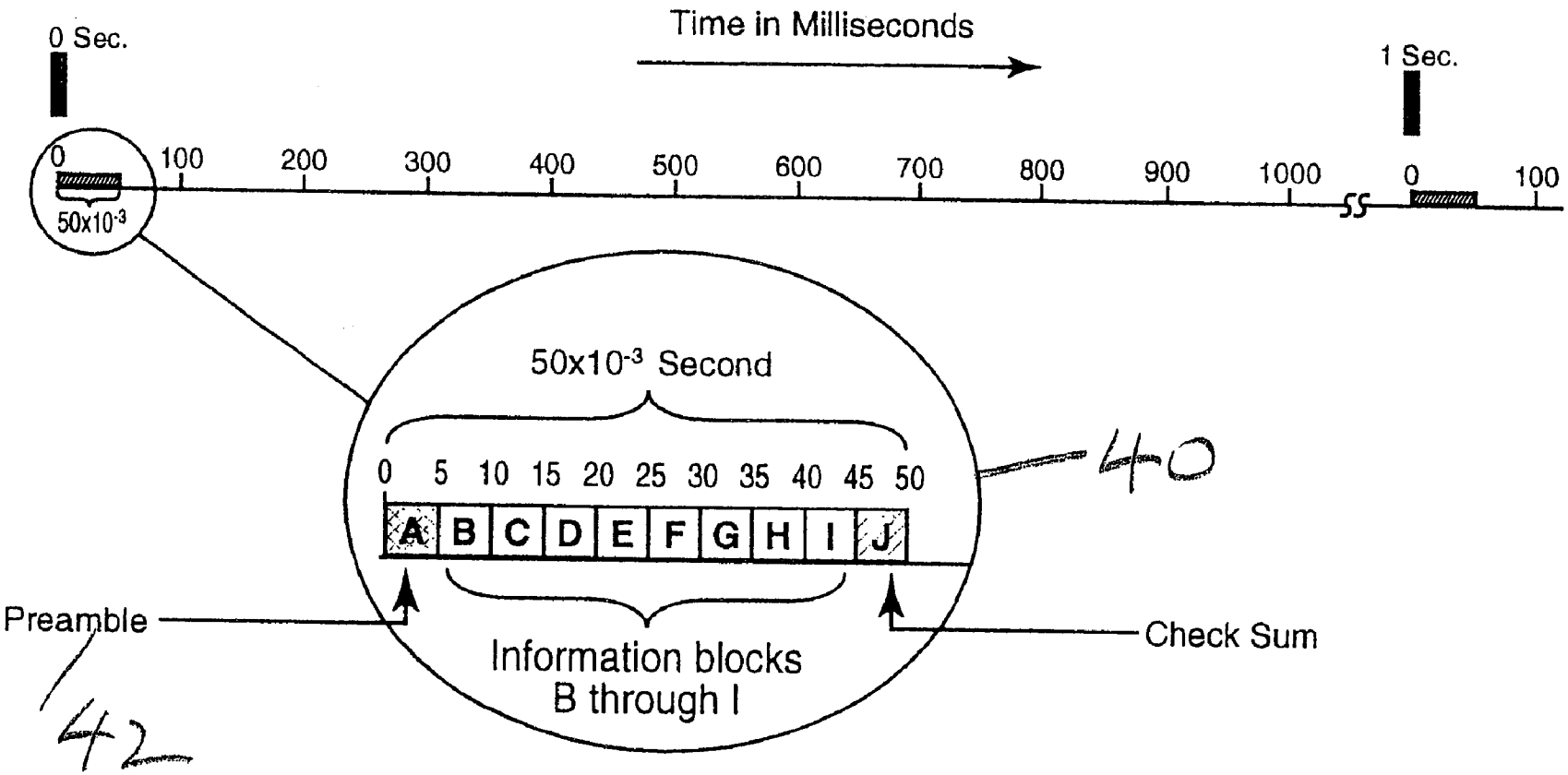
FIG. 3 illustrates a timing diagram with an enlarged data packet containing a preamble cell system ID, user ID, and an assigned power level in accordance with the present invention.

FIG. 3 illustrates a timing diagram with an enlarged data packet 40 containing a preamble 42 with cell system ID, user ID, and an assigned power level as well as an information block in accordance with the present invention. The software contained in the microprocessor 12 controls the signal processing. The radio receiver 28 continuously scans a band of frequencies. For illustrative purposes the range of 902 MHz and 928 MHz is used. These different transmitted frequencies can vary in a random like manner or may be sequentially transmitted. There are at least 100 or more different frequencies that are used with the cell system 10.

While scanning the frequencies, the resulting received RF signal strength is translated into a DC voltage. This DC voltage is signal conditioned by an analog circuit for further processing. An output signal from the analog circuit is referred to as RSSI. This is an acronym for Received Signal Strength Indicator. The RSSI output is connected directly to an analog to digital converter controlled by the microprocessor 12. This digitizing circuit processes this same RSSI signal with an output connected directly to the microprocessor 12. This processing provides the microprocessor 12 with the analog component of the RSSI voltage and a digital indication that the RSSI signal is present.

The digitized RSSI input signal is used by the microprocessor 12 to stop the frequency scanning process of receiver 28 and to determine whether the RF signal is being transmitted from the locator transceiver 36. This RSSI analysis is accomplished by recognizing a special sequence of preamble pulses unique only to a particular transmitter or transceiver, such as transmitter 26 or transceiver 36, which each have their own unique identifier. This special sequence of pulses is referred to as a preamble portion 42 of the transmitted radio message. Because the preamble portion of the radio message is uniquely encoded by a proprietary format, the microprocessor 12 can immediately identify the signal as originating from the locator transceiver 36 versus some other radio noise source.

In the event the microprocessor 12 determines this pulse is a noise source and not a specific locator transmitter, such as transceiver 36, the signal is ignored and the receiver 28 will resume scanning the received band of frequencies.

The preamble portion 42 of the transmitted message is followed by digital pulse encoded information sectors that contain the transmitted RF power level from a transmitter, such as the transmitter 26 or the locator transceiver 36. In addition to the RF power level, the name and identification number are contained in this data. Because of this unique identification preamble 42, more than one locator transmitter can transmit to the cell system 10 and each can be uniquely identified.

At the end of the digital pulse encoded information, a period of several milliseconds of continuous RF carrier will follow. During this period of time, the microprocessor 12 will use the internal analog to digital converter to take several measurements of the RSSI voltage. This measurement will be used to fine tune the received frequency to optimize the maximum attainable RSSI voltage level for this message. This process reduces the effects of a mismatch between the transmitted frequency of a locator transmitter and received frequency of a smart receiver.

In the timing diagram of FIG. 3, the enlarged radio telemetry and data format shown sets forth the transmitted data. The transmitted data is contained within a 50 millisecond, or less time frame and contains digital instructions and coded format sectors that range from "A" Through "J". All sectors must be identified via sector "A".

Sector "A" contains the digital preamble 42 and code format that the receiver 28 must receive and acknowledge before the reception of the digital data can occur.

Sector "B" thru "I" contain digital data specific to desired functions such as temperature, metabolism, heart rate, elapsed time, etc.

Sector "J" contains all of the check sum data that insures validation of all transmitted data.

All data is transmitted within a 50 millisecond time frame. This represents a 5% time period of each second. Because all transmitted or received data is less than 50 milliseconds in length, the transmitted data is less susceptible to jamming or interference. Also, because the cell system 10 or the locator system 30 are only active less than 5% on time, battery power is conserved.

Figure 5:
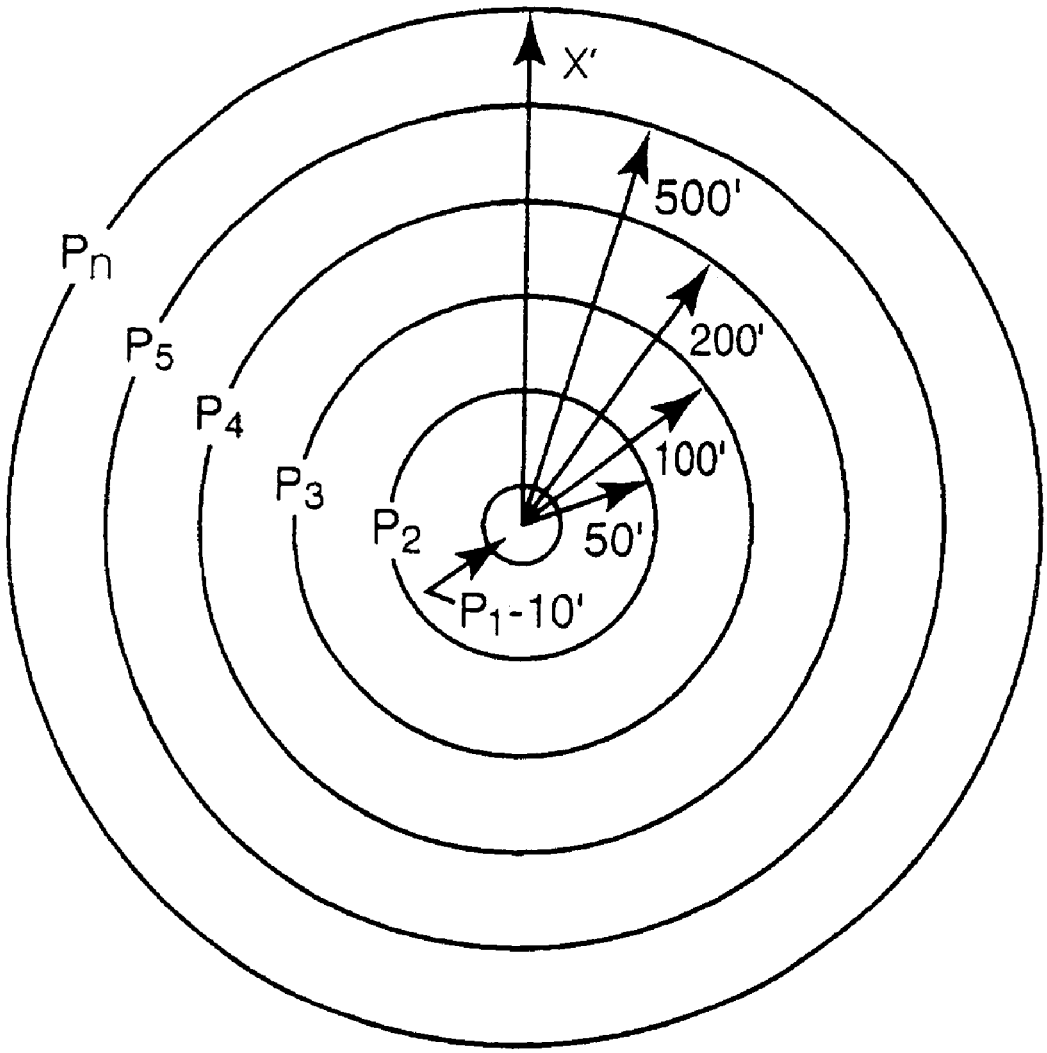
FIG. 5 illustrates an idealized power radiation pattern generated in accordance with the present invention.

In FIG. 4, the idealized radio signal is illustrated in a table format. The table in FIG. 4 presents the transmitted power $P_1$, $P_2$, $P_3$, $P_4$, $P_5$, through $P_n$. FIG. 5 illustrates the ideal power level generated area for each radio signal.

The encoded radio signal varies in transmitted signal strength for the lost person locator 30 and the encoded radio signal varies in transmitted signal strength (power). Each power level that is transmitted has a digital encoded number assigned to that particular power level and becomes the power level ID. Because the radiated power level varies in field strength, the distance at which the receiver 28 can detect this signal will be indicative of the distance the receiver 28 is from the transceiver 36.

As shown in the table in FIG. 4, a transmitter, such as transceiver 36, can transmit at several different radiated power levels that vary in signal strength from 1 microwatt through 1 watt. The encoded data (or personal ID) is assigned to at least 100 or more carrier frequencies that may vary from 902 MHz through 928 MHz or other assigned frequencies.

These different transmitted frequencies can vary in a random like manner or may be sequentially transmitted. The idealized power radiation pattern would be that for one microwatt and the received signal distance is 10 feet. This power level $P_1$ is assigned a relative field strength number of 1 and a digital encoded power level I.D. of 1.

For power level $P_2$, the assigned relative field strength number is 2 for the distance of 50 feet and a digital encoded power level I.D. of 2. The power level $P_3$ is assigned a relative field strength number of 3 and a digital encoded power level I.D. of 3 for a distance of 100 feet. A power level $P_4$ is assigned the relative field strength number of 4 with a received signal distance of 200 feet and a digital encoded power level I.D. is 4. The power level $P_5$ has a received signal distance of 500 feet, is assigned a relative field strength number of 5, and a digital encoded power level I.D. of 5. Accordingly, a power level $P_n$ is assigned a relative field strength number of "n" and a digital encoded power level I.D. of "n" with a received signal distance of X feet.

FIG. 5 illustrates a circular pattern emanating from a center. At this center, in the ideal situation, would be the lost locator unit 30. The signal is transmitted at each of the power levels as discussed with reference to FIG. 4. Thus, the signal would emanate circularly outward from the center as polar plots.

FIGS. 6A–6J illustrate polar plots of varying transmitted power levels and frequencies in accordance with the present invention. The transmitted radio signals from the locator system 30 contains the encoded message with information including the transmitted RF signal power. These signals will be received and processed by the smart radio receiver 28 of the cell system 10. The processing by the smart radio receiver 28 will include measuring the received RF signal strength, or power, from each transmitted radio message. These received RF signal power measurements will be mathematically summed and processed by the microprocessor 12 of the radio receiver 28 to calculate an average value for the received RF signal strength level for each RF power level transmitted.

The polar plots of varying transmitted power levels and frequencies follow those listed in the table illustrated in FIG. 4 and illustrated in FIG. 5. In FIGS. 6A–6J, the polar plots are shown individually so a range for each transmitted frequency at a specific power level can be easily understood. These polar plots correspond to the table illustrated in FIG. 4.

Figure 6A:
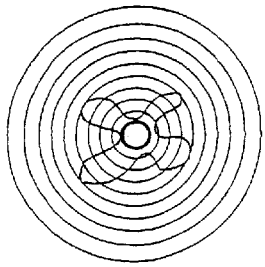
FIGS. 6A–6J illustrate polar plots of varying transmitted power levels and frequencies in accordance with the present invention.
Figure 6B:
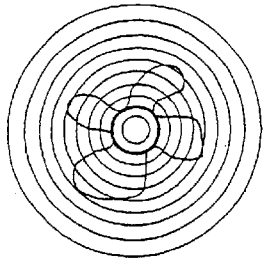
Figure 6C:
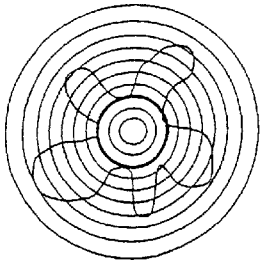

For example, in FIG. 6A, a power of 1 Microwatt is generated and is shown with frequency $f_1$. FIG. 6B illustrates frequency $f_2$ with a power of 1 Microwatt being generated. FIG. 6C illustrates power of 10 Microwatts generated with frequency $f_3$.

Figure 6D:
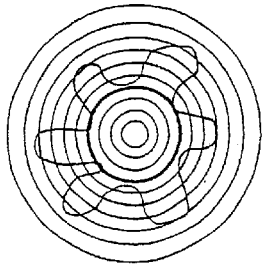
Figure 6E:
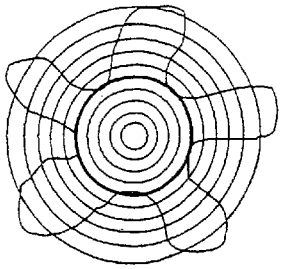
Figure 6F:
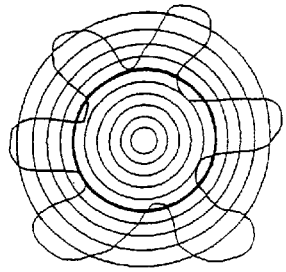
Figure 6G:
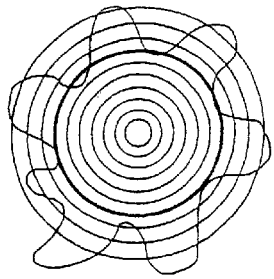

In FIG. 6D, a power of 10 Microwatts is generated and shown with frequency $f_4$. FIG. 6E shows a power of 100 Microwatts being generated with frequency $f_5$. With a frequency of $f_5$, a power of 1000 Microwatts is generated, as illustrated in FIG. 6F. FIG. 6G illustrates a power level of 1000 Microwatts being generated with a frequency of $f_7$.

Figure 6H:
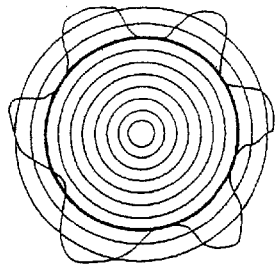
Figure 6I:
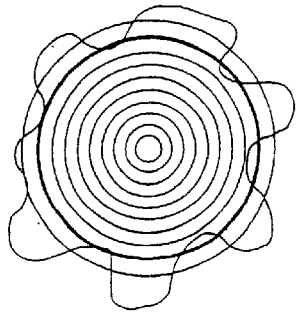
Figure 6J:
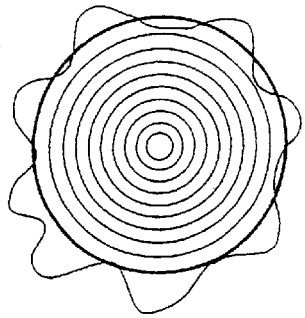

FIG. 6H illustrates a frequency of $f_8$ with a power of 10 Milliwatts being generated. With a frequency of $f_9$, there is a power of 100 Milliwatts generated, as illustrated in FIG. 6I. FIG. 6J illustrates a power level of 100 Milliwatts generated with a frequency of $f_{10}$.

Figure 7:
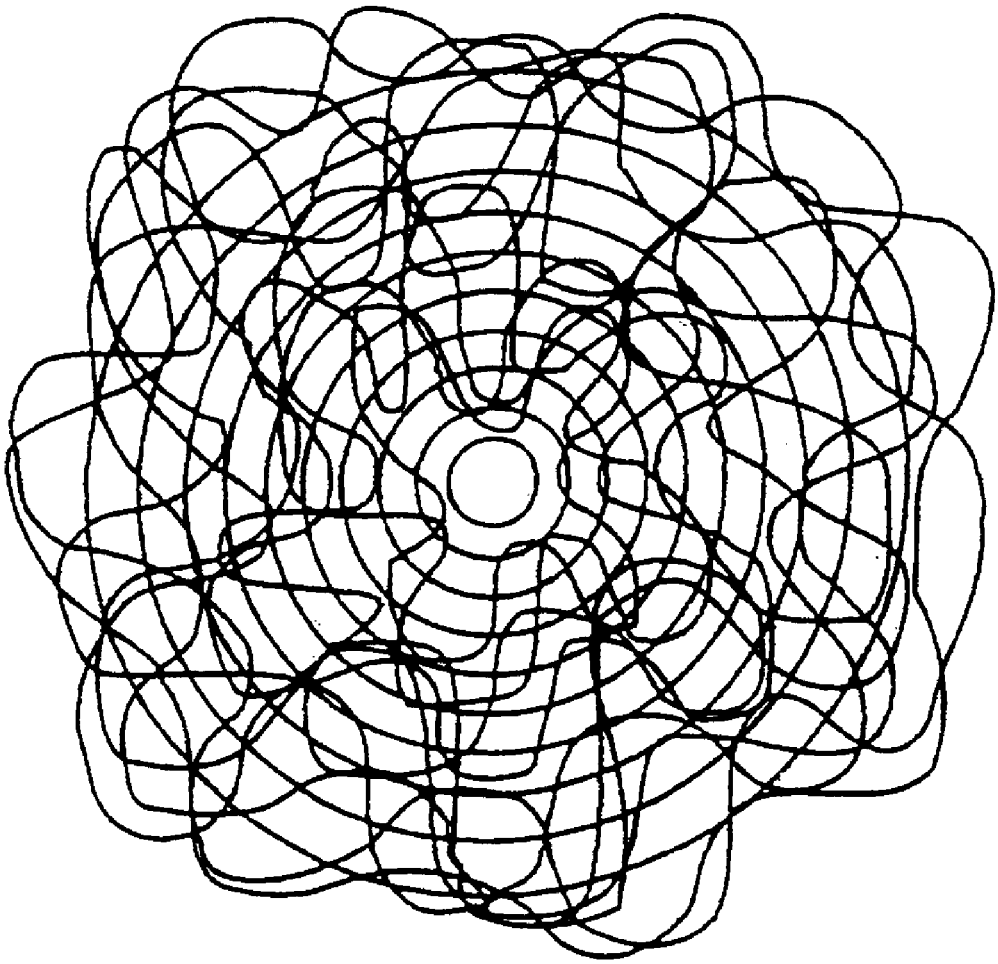
FIG. 7 illustrates a super position of various transmitted power levels and frequencies using a super cell spread transmitter in accordance with the present invention.

Now, with reference to FIG. 7, a super imposed position of various transmitted power levels and frequencies are illustrated using the transmitter 26 found in the cell system 10 or the transceiver 36 of the locator system 30. The frequencies generated are illustrated and shown to cover an entire area in the one mile radius. Repeating the transmitted message on many different frequencies at many different power levels enhances the accuracy of the distance computed. Additionally, this function of repeating will significantly reduce the effects of an uneven radiation pattern often exhibited by radio signal propagation. The uneven radiation pattern is due to various dynamic conditions such as the characteristics of the antenna and the environment.

Figure 8:
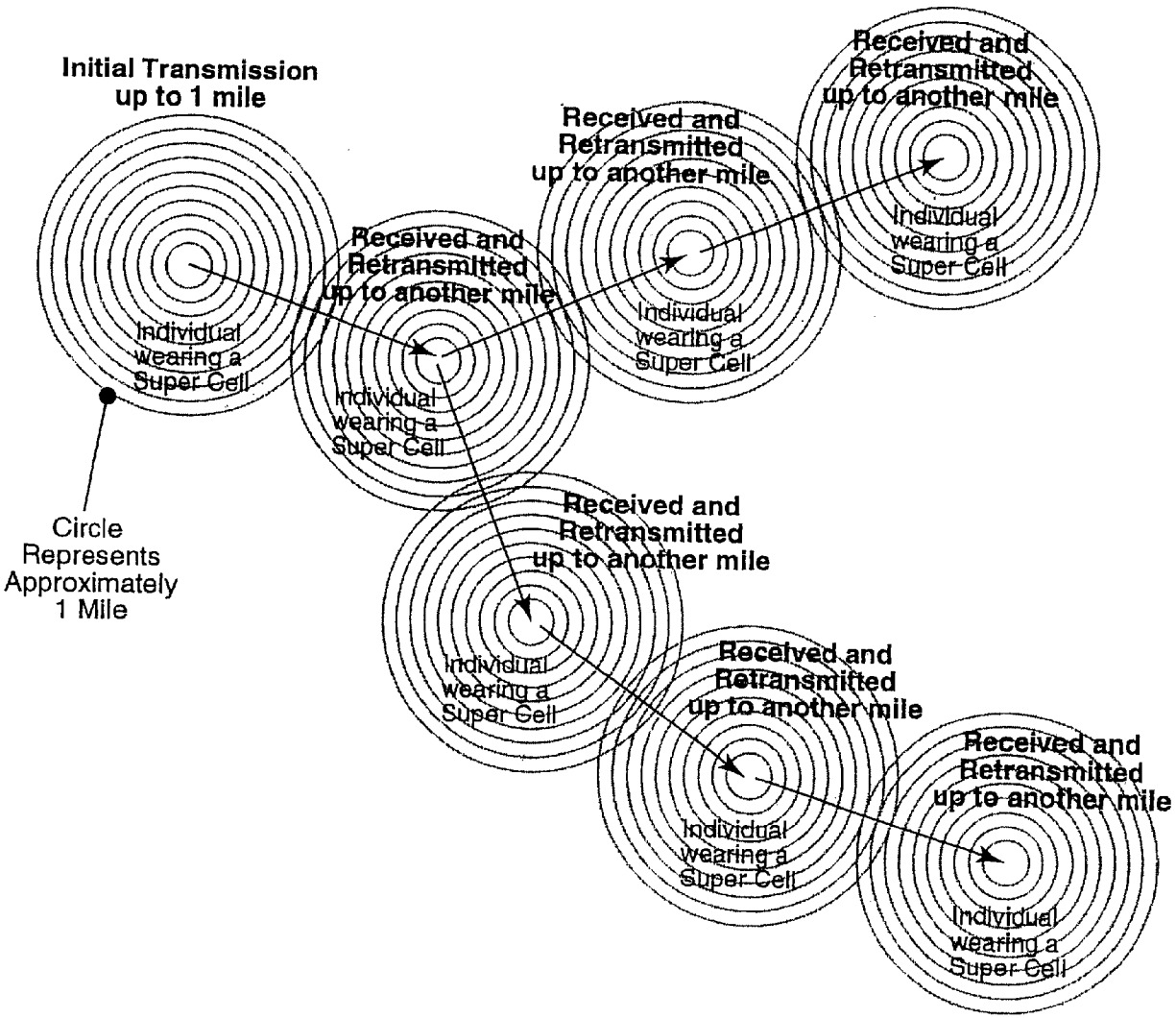
FIG. 8 illustrates a transmission of low powered radio signals over vast distances in accordance with the present invention.
Figure 10:
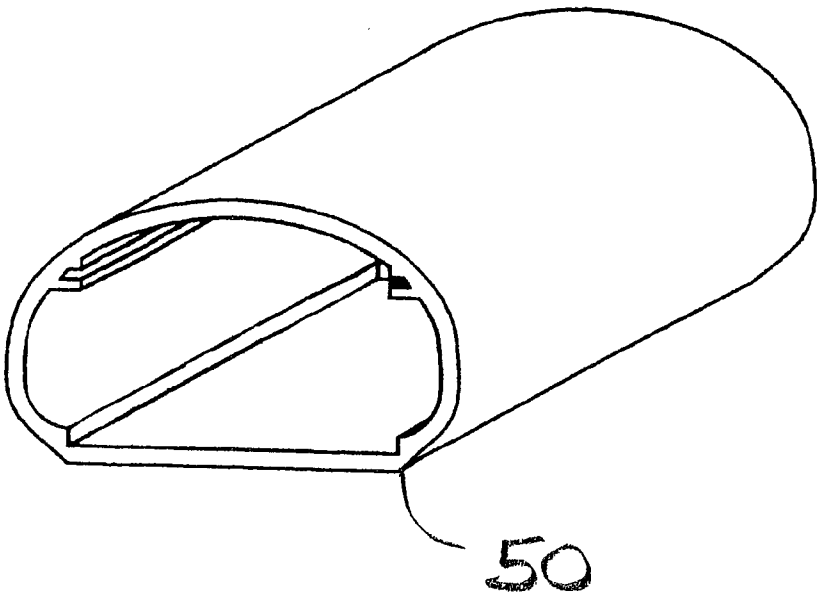
FIG. 10 illustrates a perspective view of the outside case shown in FIG. 9 in accordance with the present invention.
Figure 9:
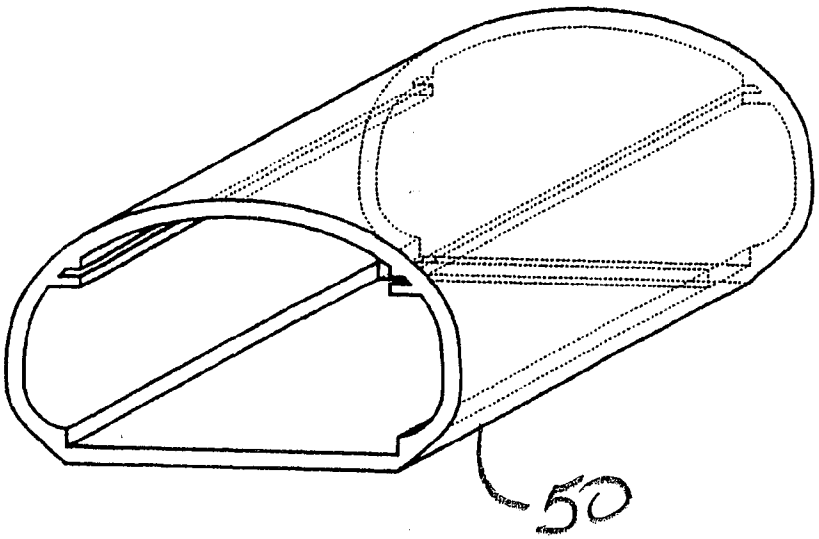
FIG. 9 illustrates a fragmentary perspective view of an outside case for use in accordance with the present invention.

FIG. 8 illustrates a concept of the invention which is a vast improvement over the previous PASS devices. This figure illustrates a transmission of low powered radio signals over vast distances. The cell system basically receives a single and then retransmits it over and over again. Thus each cell system gets an expanded range of transmission outside and beyond, its normal one mile range. To accomplish this function, the cell system acts as a spread spectrum radio repeater. Each cell system radio transmitter/receiver or transceiver is used as a repeater such that encoded radio signals from the other cell system units are immediately retransmitted. This process of retransmitting signals enables long distance communications at very low power levels and is especially valuable in areas where communication transmission is difficult such as buildings with steel structures and cement.

In practice, the cell system 10 contains the spread spectrum radio transmitter 26 and the spread spectrum radio receiver 28. The transmitter 26 has an effective range of approximately one mile. If there are three transceivers about one mile apart, and the cell system 10 immediately retransmits any signal it receives, then the effective radio transmission is approximately three miles, because of the retransmission ability of the cell systems. This procedure may be repeated to cover vast distances.

In buildings with considerable steel and concrete, the piggy-back method described with the plurality of locator systems 30 or plurality of cell systems 10 works extremely well. The radios are of the spread spectrum design and incorporate frequency hopping technology. This type of cell system may hop through several hundred frequencies within an allocated time interval thus enhancing the radio signal propagation.

With respect to the case structure of the cell system, attention is directed to FIGS. 9–21 which illustrate the case in accordance with the present invention.

The cell system 10 is contained within a watertight structure 50 that can be immersed to 100 feet or greater. The unit 50 is a small multiple part waterproof case made of high impact polycarbonated plastic. The plastic case structure is explosion proof and completely sealed from the atmosphere. The plastic case has rechargeable batteries contained within. Additionally, an induction loop is contained within the cell system structure and provides charging means for the batteries.

Figure 11:
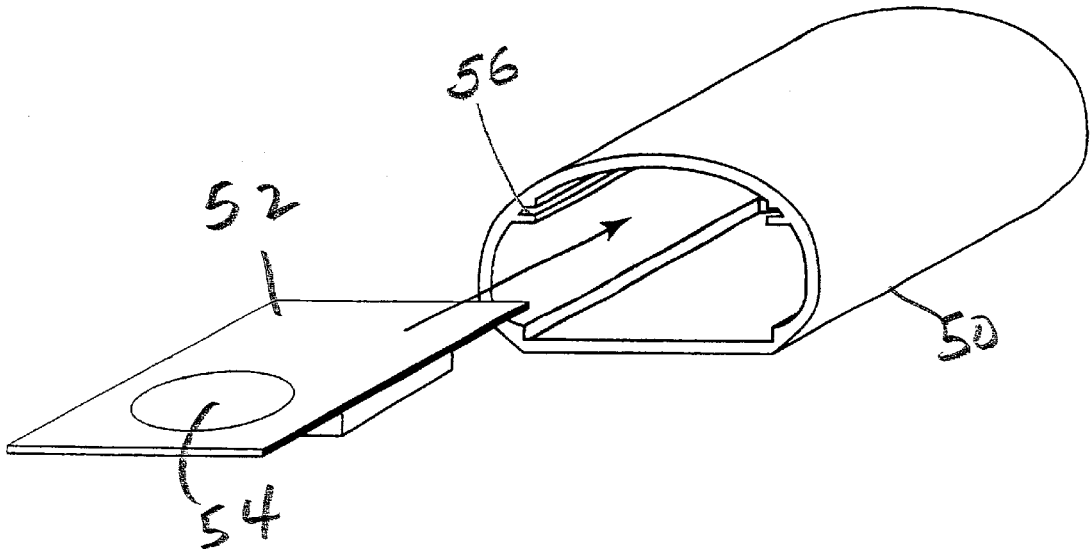
FIG. 11 illustrates a perspective view of a transponder board and a piezo electric primary sonar sound generator sliding into the case in accordance with the present invention.

FIG. 11 illustrates a perspective view of a transponder board 52 and a piezo electric primary sonar sound generator 54 sliding into the case 50 in accordance with the present invention. There is a slot ridge 56 for securely receiving the board 52. The case 50 is the secondary transducer that couples the sonar sound energy into the water. The piezo electric primary sonar sound generator 54 and a sound generating electronics are attached to the transponder board 52.

Figure 12:
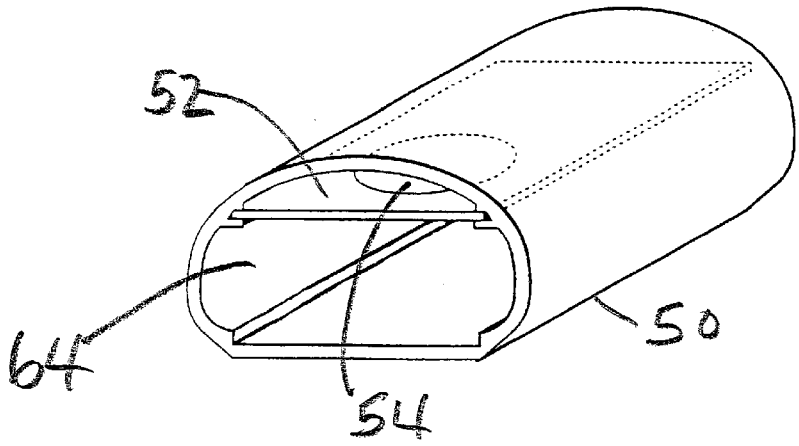
FIG. 12 illustrates a perspective view of the transponder board and the piezo electric primary sonar sound generator positioned in the case in accordance with the present invention.

FIG. 12 illustrates a perspective view of the transponder board 52 and the piezo electric primary sonar sound generator 54 positioned in the case 50. The board 52 is fixed to the upper part of the case 50 by way of the slot ridge 56, so that there is room for the battery holder.

Figure 13:
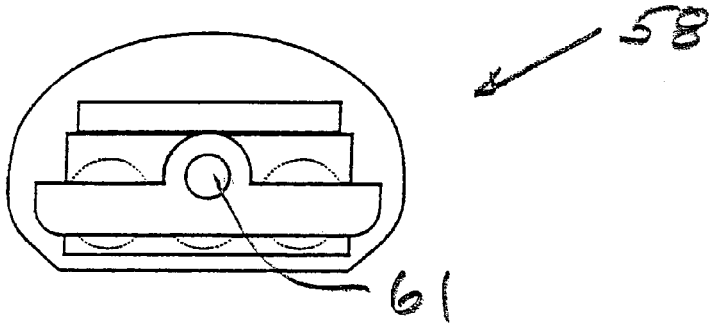
FIG. 13 illustrates a bottom view of a battery holder, a transmitter and a plurality of batteries in accordance with the present invention.
Figure 14:
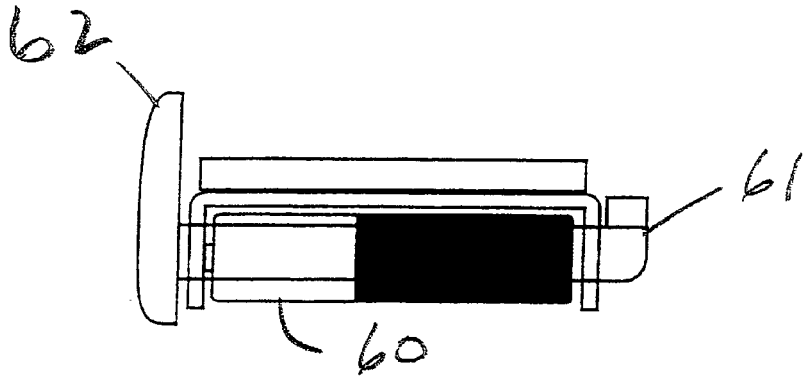
FIG. 14 illustrates a side view of the battery holder, the transmitter and the plurality of batteries in accordance with the present invention.
Figure 15:
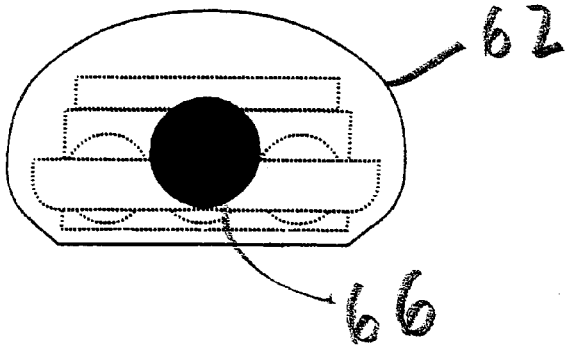
FIG. 15 illustrates a top view of the battery holder, the transmitter and the plurality of batteries in accordance with the present invention.

FIGS. 13–15 illustrate a battery holder 58. A bottom view of the battery holder 58 is illustrated in FIG. 13. The holder 58 carries two batteries, generally indicated by numeral 60, and are shown as AA batteries. Of course, smaller batteries with the same voltage can be used since the size of the holder is only restricted to the size of the current batteries. Additionally, the holder 58 includes a connection member 61 for securing the holder to the case 50. The connection member 61 can be any suitable means such as a screw or other readily attachable member.

FIG. 14 shows a side view. A top 62 is provided and has the same shape as opening 64 illustrated in FIG. 12. FIG. 15 illustrates the top 62 of the battery holder 58. In the middle of the top 62 is a button 66. The button 66 is for emergency response and is connected to the manual call for help circuit 18 shown in FIGS. 1 and 2. The button 66 can be pressed by the user to activate a call for help.

Figure 16:
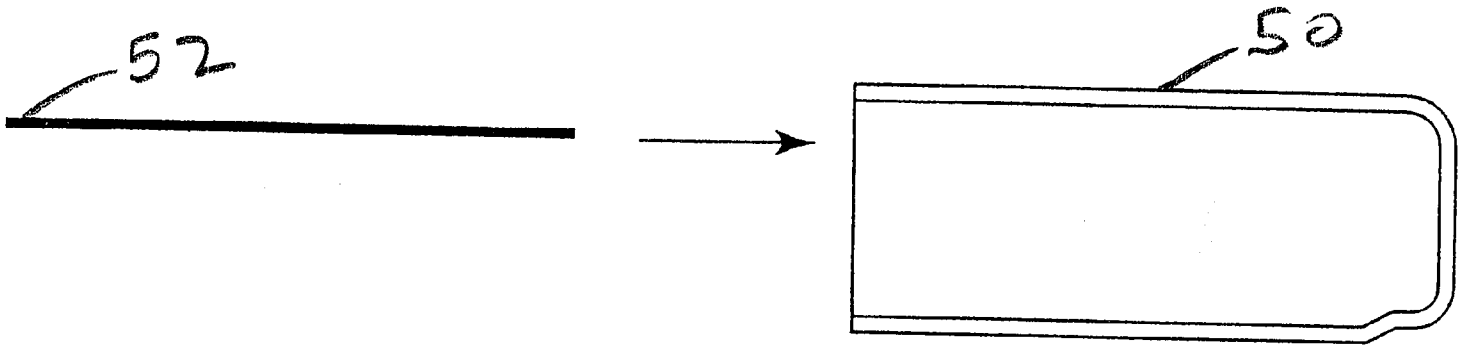
FIG. 16 illustrates a fragmentary side view of the transponder board being positioned by sliding into the case in accordance with the present invention.
Figure 17:
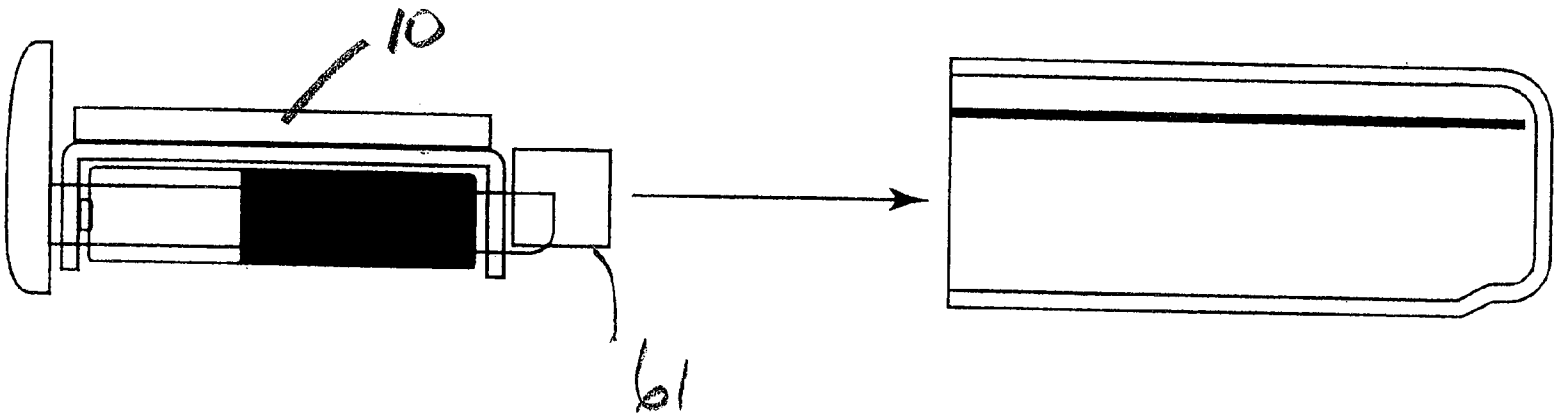
FIG. 17 illustrates a fragmentary side view of the battery holder with the transmitter and plurality of batteries being positioned by sliding into the case with the transponder in accordance with the present invention.

FIG. 16 shows a fragmentary side view of the transponder board 52 being positioned by sliding into the case 50 along the slot ridge 56 in accordance with the present invention. FIG. 17 illustrates a fragmentary side view of the battery holder 58 with the cell system 10 and plurality of batteries 60 being positioned in the case 50 by sliding into the case 50 with the transponder board 52 in position according to the present invention. The case 50 is then sealed.

Figure 18:
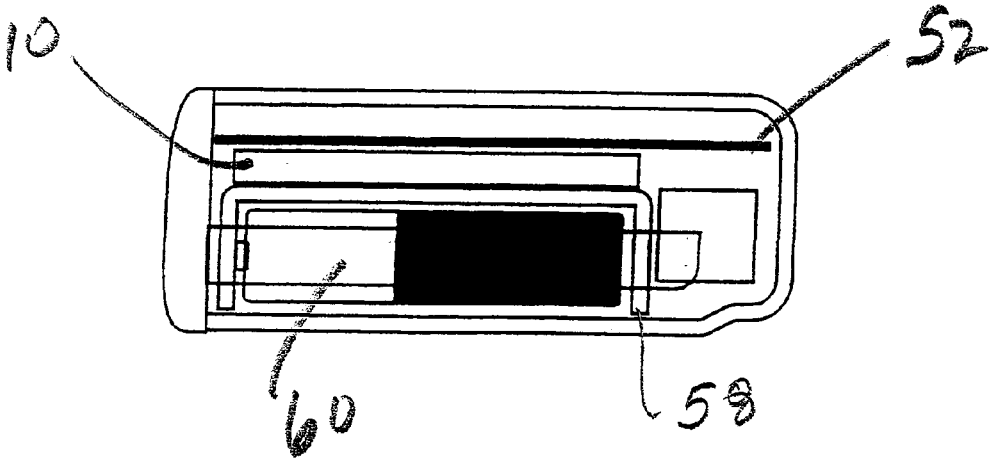
FIG. 18 illustrates a fragmentary side view of the transponder, battery holder with transmitter and plurality of batteries positioned in the case with the transponder in accordance with the present invention.

FIG. 18 illustrates a fragmentary side view of the transponder board 52, battery holder 58 with cell system 10 and plurality of batteries 60 positioned in the water tight case 50 with in accordance with the invention.

Figure 19:
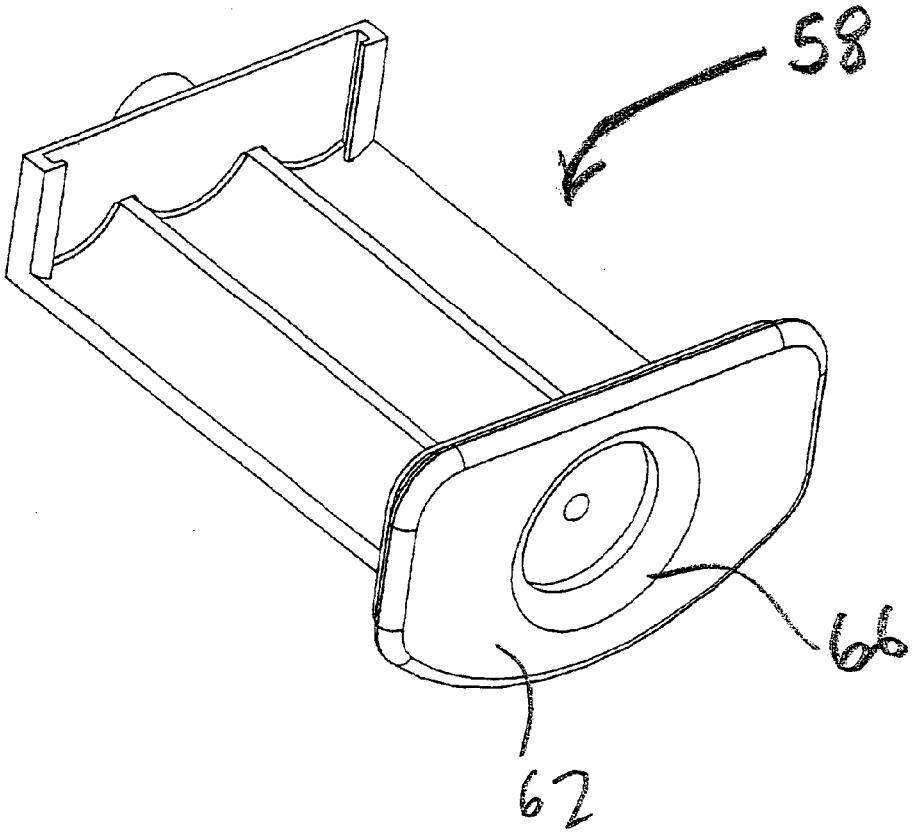
FIG. 19 illustrates a perspective view of the battery holder with the outer top in accordance with the present invention.

In FIG. 19, the battery holder 58 without the batteries 60 is illustrated. The perspective view of the battery holder 58 shows the outer top 62. It matches with the opening 64 in the case 50 in accordance with the present invention.

Figure 20:
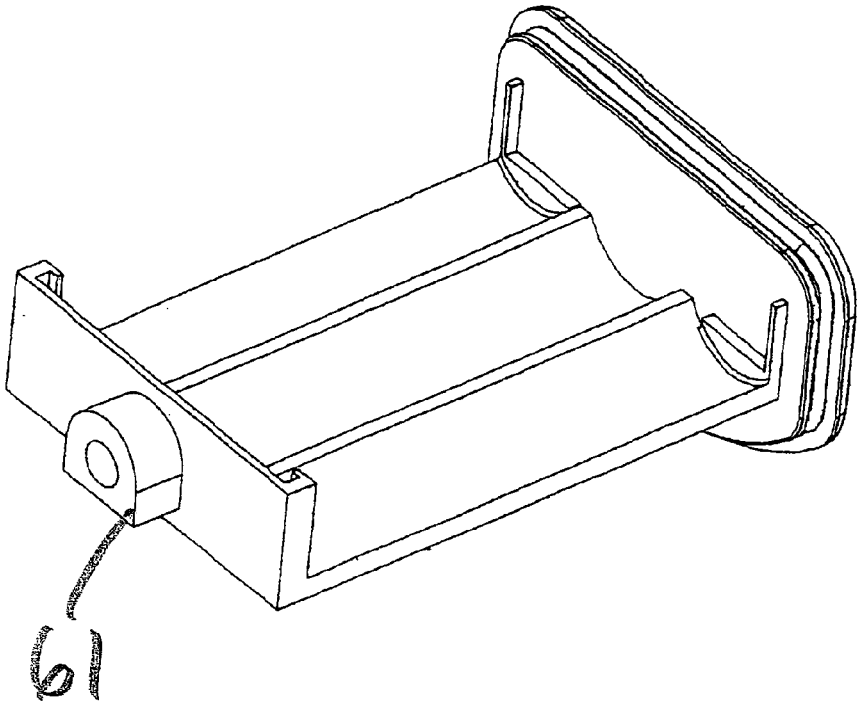
FIG. 20 illustrates a perspective view of the battery holder with the inner connector in accordance with the present invention.

FIG. 20 illustrates a perspective view of the battery holder 58 with the connection member 61 in accordance with the present invention.

Figure 21:
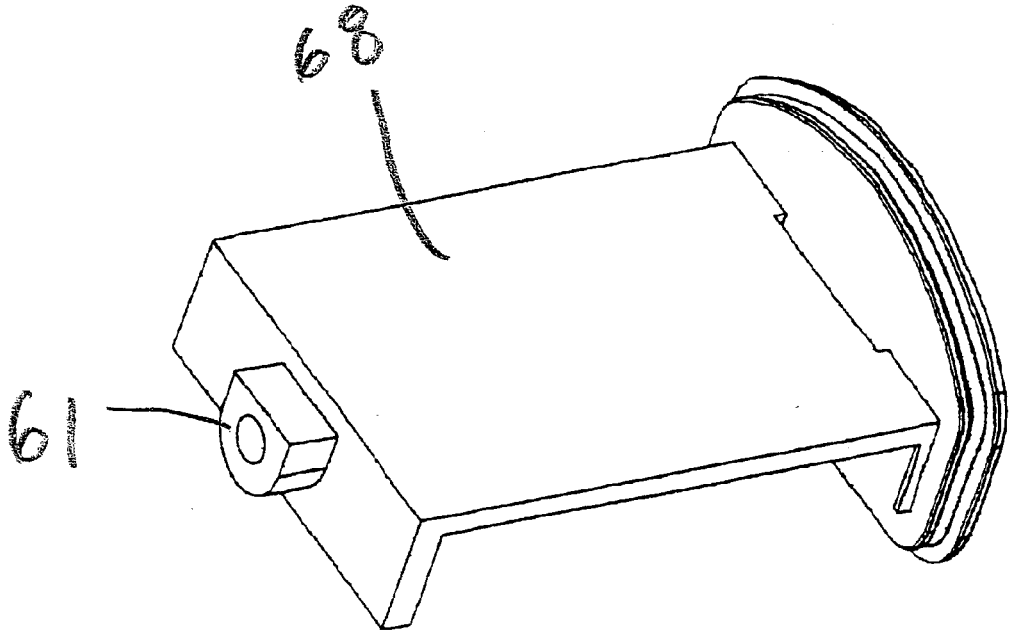
FIG. 21 illustrates a perspective view of the battery holder with the inner connector and the transmitter holder in accordance with the present invention.

FIG. 21 illustrates a perspective view of the battery holder 58 with the connection member 61 and the flat back 68 of the holder 58 in accordance with the present invention.

Figure 22:
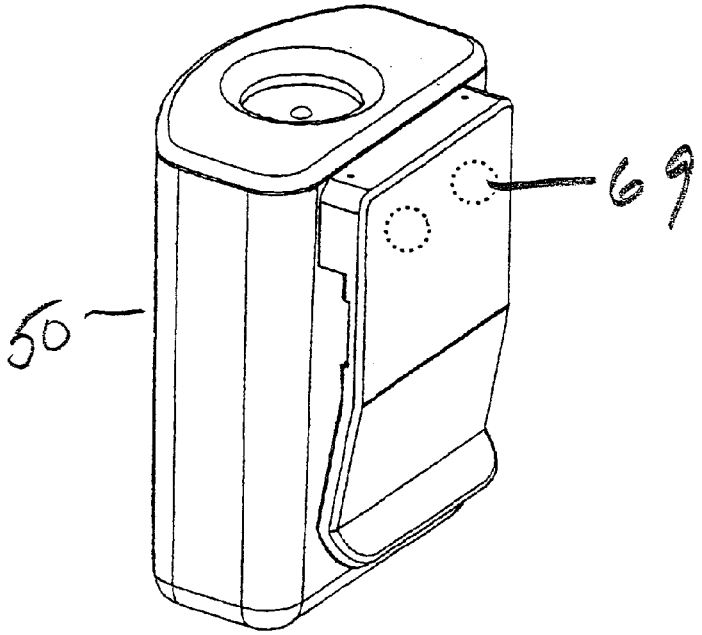
FIG. 22 illustrates a perspective view of the case structure with a slip clip in accordance with the present invention.
Figure 23:
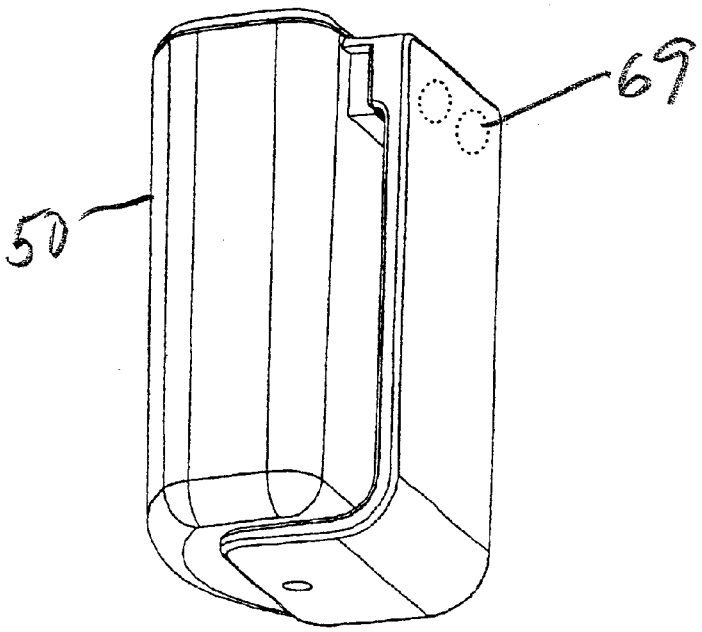
FIG. 23 illustrates a perspective view of the case structure with a locking clip in accordance with the present invention.
Figure 24:
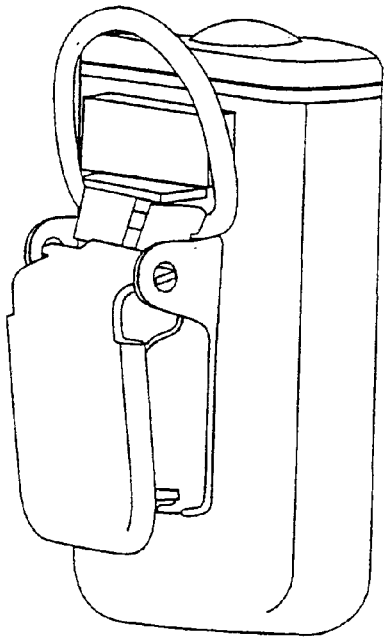
FIG. 24 illustrates a perspective view of the case structure with a grip clip in accordance with the present invention.

FIGS. 22–24 illustrate different clips or attachments for the cell system 10 in the case 50. My companion application Ser. No. 29/145,071 filed on Jul. 17, 2001 shows the small robust plastic (cylinder like) structure that measures 2¾" length, 1¾" width by 1⅛" depth and is waterproof and explosion proof. The unique design of this case will accommodate many different means for attachment to clothing, belt or other objects.

FIGS. 23–24 illustrate a perspective view of the case structure with different types of locking clips for the belt. Embedded in the case 50 are magnets 69 that permit easy attachment to steel objects such as cars, railroad box cars or other steel objects. Thus, the cell system 10 can be magnetically attached to other objects.

Figure 25:
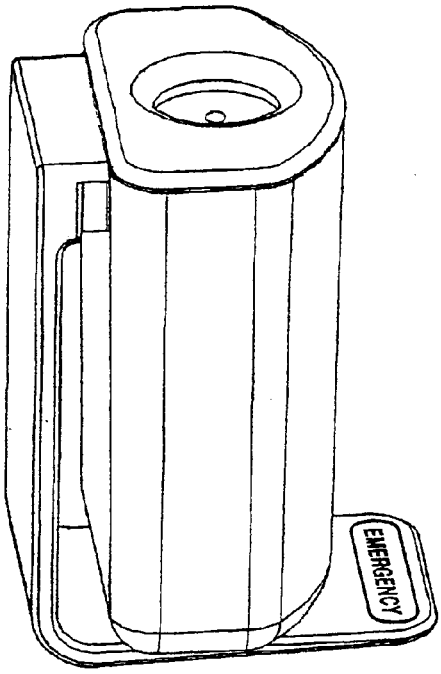
FIG. 25 illustrates a perspective view of the case structure with the locking clip and an emergency tab connected thereto in accordance with the present invention.

FIG. 25 illustrates a perspective view of the case structure with the locking clip and an emergency tab for an emergency call for help. As is shown, an automatic activation of alarm is provided.

Figure 26:
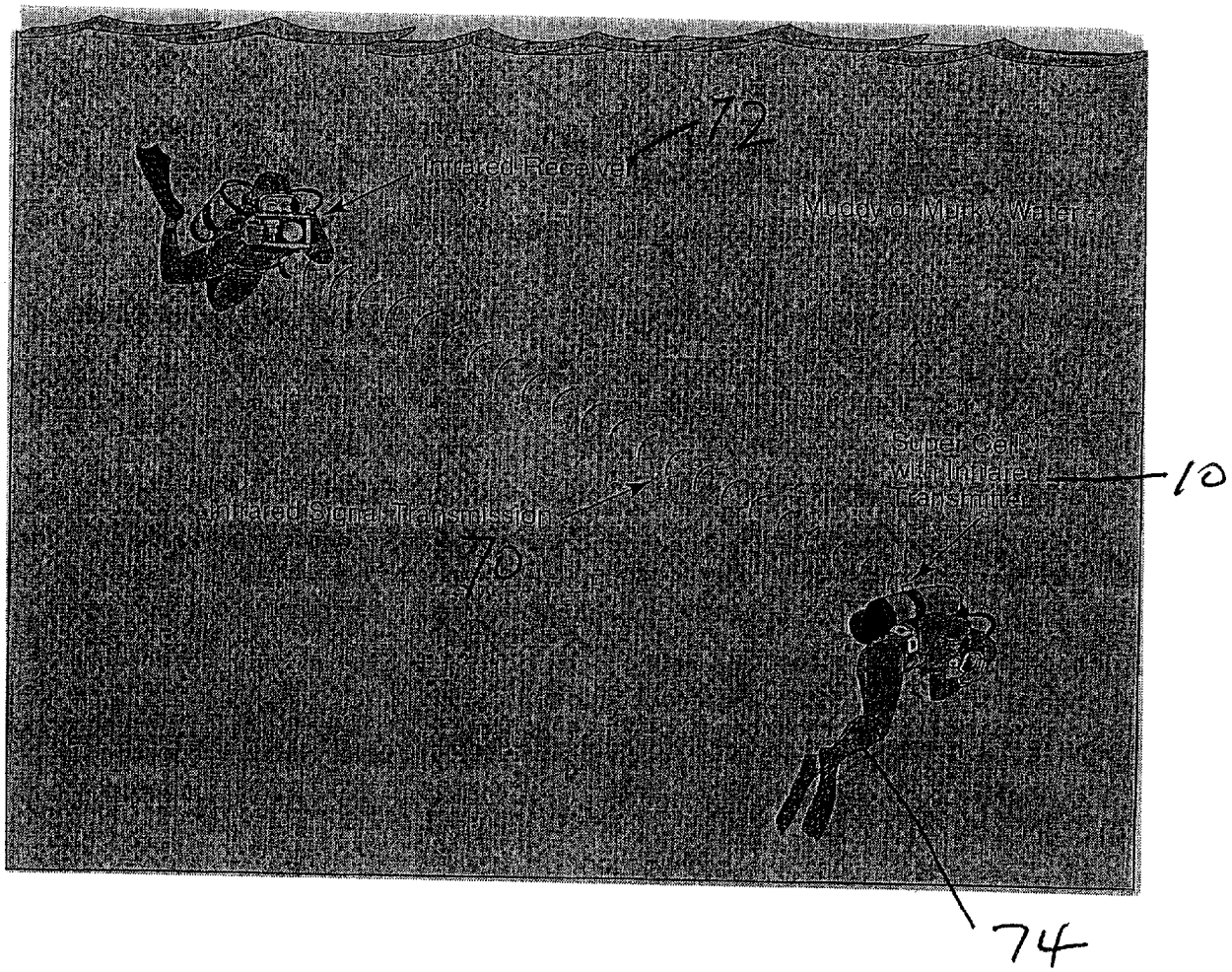
FIG. 26 illustrates an underwater example of an infrared signal being transmitted to an infrared receiver to located a diver in muddy or murky water in accordance with the present invention.

FIG. 26 illustrates an underwater example of and infrared signal 70 being transmitted to an infrared receiver 72 to locate a diver 74 in muddy or murky water in accordance with the present invention. The infrared LED 24 contained within the cell system 10 is easily detected by the remotely located infrared receiver 72. Infrared radiation (light) has the unique ability to penetrate murky and muddy waters where visibility is poor. The pulsed infrared light signal 70 may readily be encoded to convey information/data and also serves as an underwater marker or beacon.

Figure 27:
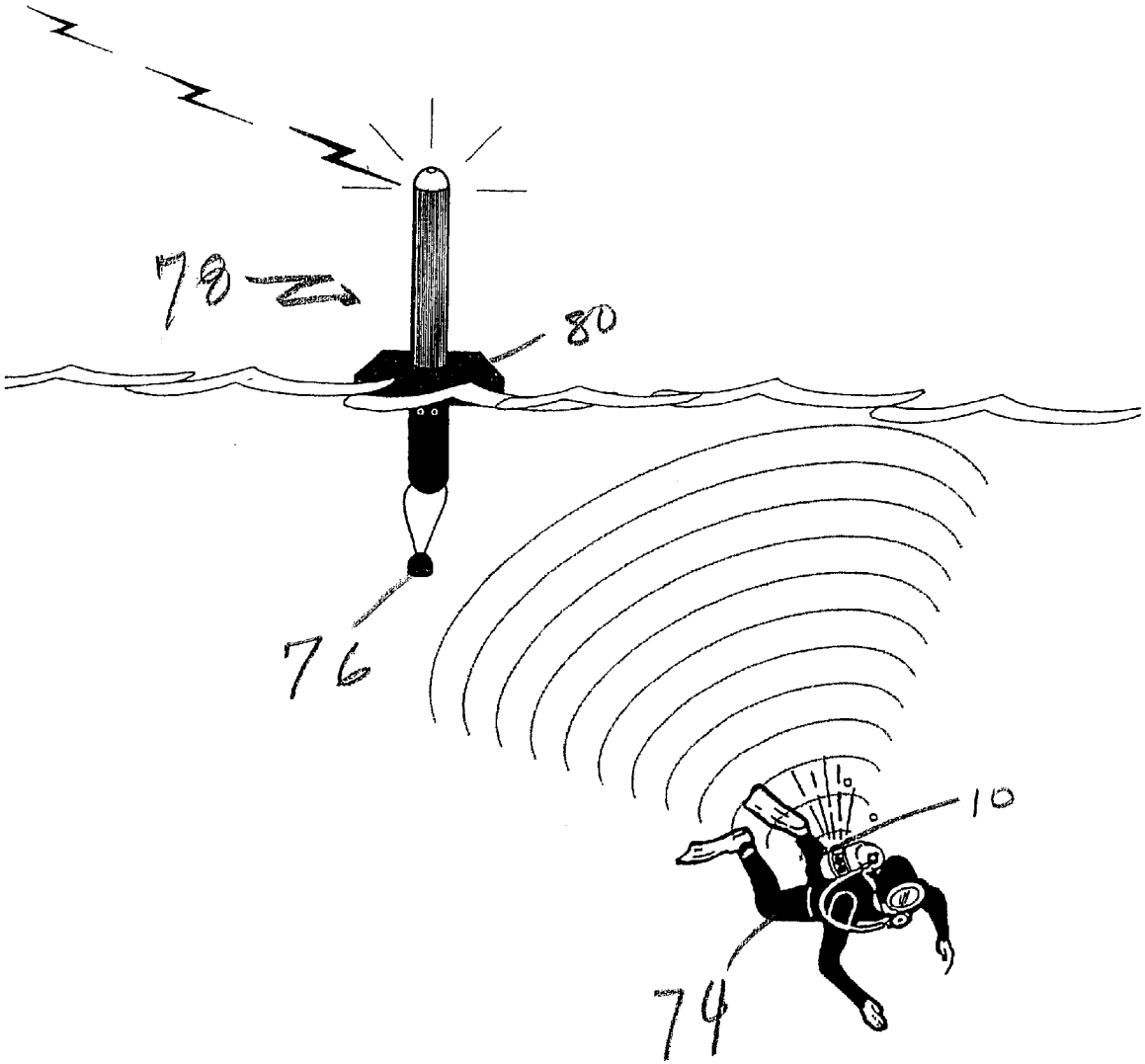
FIG. 27 illustrates an example of an acoustic sonar signaling cell system in combination with a radio transceiver with a buoy baton and float device in accordance with the present invention.

FIG. 27 illustrates an example of a sonar signaling system and underwater communications. The cell system 10 may be used as a sonar signaling device. The sound transducer generator 54 contained within the cell system 10 causes the entire case 50 to resonate at the frequency of the internal transducer. This action transponds sound energy into the water. The diver 74 can have the cell system 10 in case 50 mounted on his back or any other convenient location. A remotely located hydrophone 76 detects this signal. Attached to the hydrophone 76 is a glow and flash baton 78 which is securely connected to a floation device 80. The sound energy is pulse encoded and is detected by the remote hydrophone 76 that is attached to the baton 78. The baton 78 flashes a visual signal and activates the radio transmitter embedded therein to send out a signal similar to that discussed with reference to FIGS. 3–8.

The glow and flash baton 78 is a resilient watertight light baton and has a multicolored light source and power source mounted therein. The light sources are in electrical communication with the power source via interior electronics and solid state light sources. The exterior walls of the light baton are machined to effectively transmit light from the light source. The baton is extremely easy to use with only one hand and is controlled with a single button. The baton 78 is disclosed in my U.S. Pat. No. 6.213,623 patented Apr. 20, 2001 and is hereinafter incorporated by reference.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A multi function personal alert safety cell system having condition responsive sensor means and alarm means indicative of personal safety conditions including a small size portable casing, said casing having an internal watertight sealed cavity and a sound resonating cavity with surrounding walls including at least one sound port providing a passage from the interior to the exterior of said resonating cavity; a slidable sealed flat wall for dividing electric and electronic control; operating circuitry disposed in said chamber including a source of electric power, push button control and electronic circuitry controlled by said operating circuitry; said sealed flat wall having a thin flat sound generating piezoelectric transducer device electrically connected to said circuitry means; a motion detector for generating a voltage output characteristic of which changes responsive to motion of said casing; and said operating circuitry further including a tone oscillator connected between said motion detector and said piezoelectric sound generating transducer and responsive to the output of said motion detector and said piezoelectric sound generating transducer and responsive to the output of said motion detector to cause a specific high intensity sweeping alarm signal to be emitted when the operating circuitry is turned on and in the event that the casing is motionless, wherein the improvement comprising:

a transmitter for transmitting data unique to said cell system in said casing at multiple frequencies and at multiple power levels;

a receiver for receiving other data unique to other cell systems in other casings at multiple frequencies and at multiple power levels; and said transmitted unique data being contained within a time frame and having digital instructions and coded format sectors, said sectors being identified through a sector "A", said sector "A" containing said digital ID preamble and a data code format for another receiver to receive and acknowledge before a reception of a digital data can occur, wherein said multiple power levels being defined as $P_1$, $P_2$, $P_3$, $P_4$, $P_5$, $P_6$, that vary in signal strength from 1 microwatt through 1 watt, said power level $P_4$ is assigned a relative field strength number of 4 with a received signal distance of 200 feet and a digital encoded power level I.D. is 0100.

2. The multi function personal alert safety cell system of claim 1, wherein said power level $P_1$ is assigned a relative field strength number of 10 and a digital encoded power level I.D. of 1010.

3. The multi function personal alert safety cell system of claim 1, wherein said power level $P_2$, is assigned relative field strength number of 8 for a distance of 50 feet and a digital encoded power level I.D. of 1000.

4. The multi function personal alert safety cell system of claim 1, wherein said power level $P_3$ is assigned a relative field strength number of 6 and a digital encoded power level I.D. of 0110.

5. The multi function personal alert safety cell system of claim 1, wherein said power level $P_4$ is assigned a relative field strength number of 4 with a received signal distance of 200 feet and a digital encoded power level I.D. is 0100.

6. The multi function personal alert safety cell system of claim 1, wherein said power level $P_5$ has a received signal distance of 500 feet, is assigned a relative field strength number of 2, and a digital encoded power level I.D. of 1010.

7. The multi function personal alert safety cell system of claim 1, wherein said power level $P_6$ is assigned a relative field strength number of 1 and a digital encoded power level I.D. of 0001 with a received signal distance of 5000 feet.

8. The multi function personal alert safety cell system of claim 1, wherein said preamble personal ID being uniquely assigned to at least 100 or more carrier frequencies that vary from 902 MHz through 928 MHz.

9. The multi function personal alert safety cell system of claim 8, wherein each said different transmitted frequencies vary in a random like manner.

10. The multi function personal alert safety cell system of claim 8, wherein each said different transmitted frequencies are sequentially transmitted.

11. The multi function personal alert safety cell system of claim 1, wherein said time frame is 50 milliseconds.

12. The multi function personal alert safety cell system of claim 1, wherein said coded format sectors include a plurality of sectors "B" through "I" contain digital data specific to desired functions consisting of at least temperature, metabolism, heart rate, and elapsed time; and a sector "J" containing check sum data for insuring validation of said transmitted data.

13. A multi function personal alert safety cell system having condition responsive sensor means and alarm means indicative of personal safety conditions including a small size portable casing, said casing having an internal water-tight sealed cavity and a sound resonating cavity with surrounding walls including at least one sound port providing a passage from the interior to the exterior of said resonating cavity; a slidable sealed flat wall for dividing electric and electronic control; operating circuitry disposed in said chamber including a source of electric power, push button control and electronic circuitry controlled by said operating circuitry; said sealed flat wall having a thin flat sound generating piezoelectric transducer device electrically connected to said circuitry means; a motion detector for generating a voltage output characteristic of which changes responsive to motion of said casing; and said operating circuitry further including a tone oscillator connected between said motion detector and said piezoelectric sound generating transducer and responsive to the output of said motion detector and said piezoelectric sound generating transducer and responsive to the output of said motion detector to cause a specific high intensity sweeping alarm signal to be emitted when the operating circuitry is turned on and in the event that the casing is motionless, wherein the improvement comprising:

a transceiver for transmitting and receiving data unique to said cell system in said casing at multiple frequencies and at multiple power levels; and said transmitted and received power levels being defined as $P_1$, $P_2$, $P_3$, $P_4$, $P_5$, and $P_6$, said each power level $P_1$, $P_2$, $P_3$, $P_4$, $P_5$, and $P_6$ being transmitted and received with a digital encoded number uniquely assigned to said particular power level for defining a power level ID, said power level ID varying in field strength for defining a distance at which said transceiver detects said transmitted and received signal which is indicative of the distance said transceiver is from another separate and distinct transceiver.

14. The multi function personal alert safety cell system of claim 13, wherein said operating system includes a microprocessor controller.

15. The multi function personal alert safety system of claim 13, wherein said transmitted unique data being contained within a time frame.

16. The multi function personal alert safety system of claim 15, wherein said transmitted unique data having digital instructions and coded format sectors, said sectors being identified through a sector "A", said sector "A" containing said digital ID preamble and a data code format for another receiver to receive and acknowledge before a reception of a digital data can occur.

17. The multi function personal alert safety cell system of claim 13, wherein said multiple power levels being defined as $P_1$, $P_2$, $P_3$, $P_4$, $P_5$, and $P_6$, that vary in signal strength from 1 microwatt through 1 watt.

18. The multi function personal alert safety cell system of claim 13, wherein each said power level $P_1$, $P_2$, $P_3$, $P_4$, $P_5$, and $P_6$ being transmitted with said data and a personal ID uniquely assigned.

19. The multi function personal alert safety cell system of claim 13, wherein said power level $P_1$ is assigned a relative field strength number of 10 and a digital encoded power level I.D. of 1010.

20. The multi function personal alert safety cell system of claim 13, wherein said power level $P_2$, is assigned relative field strength number of 8 for a distance of 50 feet and a digital encoded power level I.D. of 1000.

21. The multi function personal alert safety cell system of claim 13, wherein said power level $P_3$ is assigned a relative field strength number of 6 and a digital encoded power level I.D. of 0110.

22. The multi function personal alert safety cell system of claim 13, wherein said power level $P_4$ is assigned a relative field strength number of 4 with a received signal distance of 200 feet and a digital encoded power level I.D. is 0100.

23. The multi function personal alert safety cell system of claim 13, wherein said power level $P_5$ has a received signal distance of 500 feet, is assigned a relative field strength number of 2, and a digital encoded power level I.D. of 1010.

24. The multi function personal alert safety cell system of claim 13, wherein said power level $P_6$ is assigned a relative field strength number of 1 and a digital encoded power level I.D. of 0001 with a received signal distance of 5000 feet.

25. The multi function personal alert safety cell system of claim 13, wherein said preamble personal ID being uniquely assigned to at least 100 or more carrier frequencies that vary from 902 MHz through 928 MHz.

26. The multi function personal alert safety cell system of claim 13, wherein each said different transmitted frequencies vary in a random like manner.

27. The multi function personal alert safety cell system of claim 13, wherein each said different transmitted frequencies are sequentially transmitted.

28. The multi function personal alert safety cell system of claim 15, wherein said time frame is 50 milliseconds.

29. The multi function personal alert safety cell system of claim 16, wherein said coded format sectors include a plurality of sectors "B" through "I" contain digital data specific to desired functions consisting of at least temperature, metabolism, heart rate, and elapsed time; and a sector "J" containing check sum data for insuring validation of said transmitted data.

30. A plurality of multi function personal alert safety cell systems, comprising:

a plurality of transceivers, each said transceiver for transmitting and receiving at several different radiated power levels, defined as $P_1$, $P_2$, $P_3$, $P_4$, $P_5$, and $P_6$, that vary in signal strength from 1 microwatt through 1 watt, each said power level $P_1$, $P_2$, $P_3$, $P_4$, $P_5$, and $P_6$ being transmitted and received with encoded data and a personal ID uniquely assigned to each of said plurality of transceivers;

said plurality of transceivers transmitting and receiving data being contained within a time frame and having digital instructions and coded format sectors, said sectors being identified through a sector "A"; and said personal ID varying in field strength for defining a distance at which one of said transceivers detects said transmitted and received signal from another of said plurality of transceivers and said signal being indicative of the distance of one of said transceiver is from another of said transceivers.

31. The plurality of multi function personal alert safety cell systems of claim 30, wherein said multiple power levels being defined as $P_1$, $P_2$, $P_3$, $P_4$, $P_5$, and $P_6$, that vary in signal strength from 1 microwatt through 1 watt.

32. The plurality of multi function personal alert safety cell systems of claim 31, wherein each said power level $P_1$, $P_2$, $P_3$, $P_4$, $P_5$, and $P_6$ being transmitted with said data and a personal ID uniquely assigned.

33. The plurality multi function personal alert safety cell systems of claim 32, wherein said power level $P_1$ is assigned a relative field strength number of 10 and a digital encoded power level I.D. of 1010.

34. The plurality of multi function personal alert safety cell systems of claim 32, wherein said power level $P_2$, is assigned relative field strength number of 8 for a distance of 50 feet and a digital encoded power level I.D. of 1000.

35. The plurality of multi function personal alert safety cell systems of claim 34, wherein said power level $P_3$ is assigned a relative field strength number of 6 and a digital encoded power level I.D. of 0110.

36. The plurality of multi function personal alert safety cell systems of claim 32, herein said power level $P_4$ is assigned a relative field strength number of 4 with a received signal distance of 200 feet and a digital encoded power level I.D. is 0100.

37. The plurality of multi function personal alert safety cell systems of claim 32, wherein said power level $P_5$ has a received signal distance of 500 feet, is assigned a relative field strength number of 2, and a digital encoded power level I.D. of 1010.

38. The plurality of multi function personal alert safety cell systems of claim 32, wherein said power level $P_6$ is assigned a relative field strength number of 1 and a digital encoded power level I.D. of 0001 with a received signal distance of 5000 feet.

39. The plurality of multi function personal alert safety cell systems of claim 30, wherein said preamble personal ID being uniquely assigned to at least 100 or more carrier frequencies that vary from 902 MHz through 928 MHz.

40. The plurality of multi function personal alert safety cell systems of claim 39, wherein each said different transmitted frequencies vary in a random like manner or may be sequentially transmitted.

41. The plurality of multi function personal alert safety cell systems of claim 39, wherein each said different transmitted frequencies are sequentially transmitted.

42. The plurality of multi function personal alert safety cell systems of claim 39, wherein said time frame is 50 milliseconds.

43. The plurality of multi function personal alert safety cell systems of claim 30, wherein said sector "A" containing said digital preamble and a code format for identifying each of said plurality of said transceivers.

44. The plurality of multi function personal alert safety cell systems of claim 30, wherein said each transceiver receiving and acknowledging before a reception of said digital data can occur.

45. The plurality of multi function personal alert safety cell systems of claim 30, wherein said transmitted data having a plurality of sectors "B" through "I" containing digital data specific to desired functions consisting of at least temperature, metabolism, heart rate, and elapsed time.

46. The plurality of multi function personal alert safety cell systems of claim 30, wherein said transmitted data having a sector "J" containing check sum data for insuring validation of said transmitted data.

47. The plurality of multi function personal alert safety cell systems of claim 30, wherein each said cell system including a microprocessor controller.

48. The plurality of multi function personal alert safety cell systems of claim 30, wherein each said cell system includes a sonar transducer.

49. The plurality of multi function personal alert safety cell systems of claim 30, wherein said plurality of unique transceivers communicate by infrared communications.

50. The plurality of multi function personal alert safety cell systems of claim 30, wherein said plurality of unique transceivers operate as repeaters to extend a range of the systems using low radiated RF power.

51. The plurality of multi function personal alert safety cell systems of claim 30, wherein said plurality of unique transceivers operate as repeaters to extend a range of the systems using low radiated RF power.

* * * * *